US007851070B2

(12) United States Patent
Narita et al.

(10) Patent No.: US 7,851,070 B2
(45) Date of Patent: Dec. 14, 2010

(54) DIFFUSION BARRIER ALLOY FILM AND HIGH-TEMPERATURE APPARATUS MEMBER

(75) Inventors: Toshio Narita, Hokkaido (JP); Hiroshi Yakuwa, Kanagawa (JP)

(73) Assignee: National University Corporation Hokkaido University, Hokkaido (JP)

( * ) Notice: Subject to any disclaimer, the term of this patent is extended or adjusted under 35 U.S.C. 154(b) by 683 days.

(21) Appl. No.: 10/585,780

(22) PCT Filed: Jan. 14, 2005

(86) PCT No.: PCT/JP2005/000734

§ 371 (c)(1),
(2), (4) Date: Nov. 30, 2007

(87) PCT Pub. No.: WO2005/068685

PCT Pub. Date: Jul. 28, 2005

(65) Prior Publication Data

US 2008/0081214 A1 Apr. 3, 2008

(30) Foreign Application Priority Data

Jan. 15, 2004 (JP) ..... 2004-007540

(51) Int. Cl.
*B32B 15/01* (2006.01)
*B32B 15/04* (2006.01)
*B32B 15/18* (2006.01)
*B32B 15/20* (2006.01)

(52) U.S. Cl. ..... 428/665; 428/655; 428/663; 428/667; 428/633

(58) Field of Classification Search ..... 428/655, 428/663, 665, 667, 651, 666, 632, 633
See application file for complete search history.

(56) References Cited

U.S. PATENT DOCUMENTS

| | | | | |
|---|---|---|---|---|
| 4,417,173 | A * | 11/1983 | Tuck et al. | 313/346 R |
| 5,556,713 | A | 9/1996 | Leverant | |
| 6,306,524 | B1 | 10/2001 | Spitsberg et al. | |
| 6,746,782 | B2 | 6/2004 | Zhao et al. | |
| 6,830,827 | B2 | 12/2004 | Narita et al. | |
| 6,899,926 | B2 | 5/2005 | Narita et al. | |
| 7,060,368 | B2 | 6/2006 | Narita et al. | |
| 2001/0026877 | A1 | 10/2001 | Narita et al. | |

FOREIGN PATENT DOCUMENTS

| | | |
|---|---|---|
| EP | 1 449 937 | 8/2004 |

(Continued)

*Primary Examiner*—Michael La Villa
(74) *Attorney, Agent, or Firm*—Wenderoth, Lind & Ponack, L.L.P.

(57) ABSTRACT

A diffusion barrier alloy film has a diffusion barrier layer which has more excellent diffusion barrier properties than an Re—Cr alloy film, and can stand usage at higher temperatures (e.g., 1150° C. or higher). The diffusion barrier layer is made of an Re—W alloy σ phase containing 12.5 to 56.5% of W in terms of atomic composition and the remainder of Re excluding unavoidable impurities. A metal base has a surface coated with a diffusion barrier layer. If required, the diffusion barrier layer has a surface coated with a diffusion alloy layer containing 10% or greater and less than 50% of Al, Cr, or Si in terms of atomic composition, providing a high-temperature apparatus member.

12 Claims, 16 Drawing Sheets

FOREIGN PATENT DOCUMENTS

| | | |
|---|---|---|
| JP | 01-215937 | 8/1989 |
| JP | 09-143667 | 6/1997 |
| JP | 2001-323332 | 11/2001 |
| WO | 02/27067 | 4/2002 |
| WO | 03/038152 | 5/2003 |

* cited by examiner

DIFFUSION BARRIER ALLOY FILM AND HIGH-TEMPERATURE APPARATUS MEMBER

TECHNICAL FIELD

The present invention relates to a diffusion barrier alloy film for use as a surface film (coating film) for extending the service life of a high-temperature apparatus member, which is used at a high temperature, such as a gas turbine blade, a jet engine turbine blade, a combustor, a nozzle, a boiler heat transfer pipe, a waste disposal apparatus, a semiconductor fabrication discharge gas treating apparatus, or the like, a method of manufacturing such an alloy film, and a high-temperature apparatus member incorporating such an alloy film.

BACKGROUND ART

High-temperature apparatus members, such as industrial gas turbine blades, jet engines, or the like, for example, are subject to a fluid temperature in excess of 1300° C. Those members, which are made of a metal material, are susceptible to damage due primarily to high-temperature oxidation. For the purpose of making the members resistant to heat, it has heretofore been the general practice to apply a coating to surfaces of the members according to one of the following processes:

(1) Thermal Barrier Coating (TBC):

Thermal barrier coating (TBC) is a laminated assembly of a ceramics layer called a topcoat and a corrosion-resistant alloy layer called an undercoat (or a bond coat), which are successively deposited on a surface of a metal base (member). The topcoat is generally made of $ZrO_2$ having a small coefficient of thermal conductivity for mainly lowering the surface temperature of the metal base to about 1000° C. or lower. The undercoat is, on the other hand, generally made of an alloy (normally referred to as MCrAlY) containing several to several tens % of Al in order to make it resistant to oxidation.

In recent years, fluid temperatures tend to be higher for higher electric power generating efficiency, and accordingly the surface temperature of the undercoat also tends to be higher. This tendency results in a serious problem in that a thick oxide film grows in the interface between the undercoat and the topcoat, causing the topcoat to peel off and at the same time causing Al to be diffused from MCrAlY into the metal base thereby to reduce the strength of the metal base. Even at conventional temperatures, jet engine turbine blades, for example, are said to have a service life of a half year even if the thermal barrier coating is applied to their surface. Consequently, there has been a strong demand for the development of a technology for extending the service life of these members. It has been said that one of the major causes of the degradation of the TBC system is a mutual diffusion of alloy components between the undercoat and the metal base.

Furthermore, the TBC system requires a topcoat having a thickness of several hundreds μm and cooling air for increasing the effect of temperature reduction. Therefore, the TBC is generally not suitable for use in small regions and regions where cooling air is not available.

(2) Al (or Cr, Si) Diffusion Process:

Members (metal bases), which need to have oxidation resistance and high-temperature corrosion resistance at 1000° C. or lower, are often treated with Al, Cr, or Si by the diffusion process. It is known that the oxides of these elements have a small ion diffusion capability and hence members whose surface is coated with these oxides are less susceptible to high-temperature oxidation and high-temperature corrosion. To form these oxides, therefore, a surface of a member is coated with an alloy film containing several tens % of one of these elements. One typical coating process is known as a diffusion process. An alloy film (coating film) formed by this process is highly adhesive to a member (metal base) as it forms a diffused layer, and is applicable to components having complex shapes and to small parts.

However, as with the above-described TBC system, when the alloy film thus formed is used at a high temperature for a long period of time, a mutual diffusion of alloy components occurs between the alloy film and the metal base, reducing the concentration of Al (or Cr, Si) in the alloy film to the extent that sound corrosion-resistant oxides are no longer available.

(3) Ni—Cr or MCrAlY Spraying:

It is also generally customary to spray Ni—Cr or MCrAlY onto a surface of a metal base to form an alloy film thereon. The spraying process is advantageous in that the composition of the alloy film can freely be selected. However, since the alloy film is a porous film, it is generally difficult to form a good-quality film as a high-temperature-resistant, corrosion-resistant coating layer. Furthermore, the spraying process is defective in that the use of a spray gun puts a limitation on the shapes of members to which the spraying process is applicable, and it is difficult to form thin films having a thickness of about 10 μm or smaller. Though the sprayed alloy film remains effective in short-term usage, it tends to reduce the corrosion resistance of the metal base (member) when used at high temperatures for a long period of time for the same reasons as described above in (2).

(4) Deposition (PVD), Particularly Electron Beam Deposition (EB-PVD):

In recent years, attention has been paid to EB-PVD as a process of forming TBC. This is because EB-PVD is capable of forming a dense, thick (several hundreds μm), and uniform metal film unlike PVD that finds it difficult to form thick metal films.

However, it is generally difficult to apply EB-PVD to parts having small clearances though it is possible to form a metal film on a curved surface by rotating the metal base. EB-PVD is also highly costly to perform. As with above-described (1) through (3), the degradation of an alloy film formed by EB-PVD is unavoidable due to a mutual alloy diffusion between the alloy film and the metal base when the member is used for a long period of time or at an ultrahigh temperature.

(5) Pt Electroplating+Al Diffusion:

In recent years, it has been known that a plated film of Pt is formed on a surface of a metal base (member) by electroplating and thereafter Al is diffused into the plated film to produce an oxidation-resistant coating on a jet engine turbine blade, for example. Specifically, Pt is added to nickel aluminide (i-NiAl) that is widely used as a corrosion-resistant layer material for thereby stabilizing the layer to keep the alloy film (coating layer) in sound conditions for a long period of time.

(6) TBC System with a Re-Added Undercoat:

There has been proposed a TBC system including an undercoat to which 12 weight % (several mol %) or less of Re is added (see, for example, Japanese laid-open patent publication No. H11-61439). A TBC system containing 35 to 60 weight % (about 15 to 30 mol %) of Re has also been proposed (see, for example, PC(WO) No. 2000-511236). However, no detailed description has been given as to the role of Re, and the effect of Re is uncertain.

(7) Diffusion Barrier of Re—Cr Alloy:

A common problem of the technologies described above in (1) through (6) is that when the member has been used at a high temperature of about 1000° C. or higher or for a long period of time at a temperature of 1000° C. or lower, the concentration of Cr, Al, or Si in a corrosion-resistant oxide film coating layer of, e.g., $Al_2O_3$, $Cr_2O_3$, or $SiO_2$ is lowered due to a mutual alloy diffusion between the coating layer (alloy film) and the metal base, making the coating layer less resistant to corrosion. When Pt-added β-Ni(Pt)Al has been used at a high temperature of 1000° C. or higher or for a long period of time at a temperature of 1000° C. or lower, since Pt has a low melting point of about 1770° C., it is expected that Pt is diffused into the metal base, and the coating layer becomes less resistant to corrosion.

The inventors have proposed a Re alloy film for use as a diffusion barrier for preventing a mutual diffusion between a coating layer and a metal base (see Japanese laid-open patent publication No. 2001-323332). The inventors have also proposed an Re—Cr alloy film (see International Publication No. 03/038150), an Re—Cr—Ni alloy film (see International Publication No. 03/038151), and an Re—(Cr,Mo,W)—(Ni,Co,Fe) alloy film (see International Publication No. 03/0381512) as alloy film compositions having an excellent diffusion prevention capability. These diffusion barrier alloy films mainly have an Re—Cr alloy σ phase as a basic composition, and may have their composition optimized for the base, the application, and the temperature range in which they are to be used.

SUMMARY OF THE INVENTION

The melting point of Re is 3180° C., and the melting point of Cr is 1857° C. Therefore, it can be seen that a diffusion barrier alloy film made of an Re—Cr alloy as a basic composition is expected to have a melting point of about 2500° C. and has an excellent diffusion barrier property. If the Re—Cr alloy is alloyed with a component having a melting point in the range from 1450 to 1550° C., such as Ni, Fe, Co, or the like, on the other hand, then the resulting alloy has a lower melting point as a diffusion barrier and slightly lower diffusion barrier property than the Re—Cr alloy. Depending on the application and the temperature range in which it is to be used, the alloy maintains a sufficient diffusion barrier property and hence sufficiently contributes to the prolonging of the service life of the high-temperature apparatus member. In some cases, however, a better diffusion barrier property is required.

Ni, Fe, and Co are most generally used as materials for a heat-resistant alloy base. In a process of forming a diffusion barrier alloy film on the surface of the base, it is generally difficult to completely prevent these elements from being mixed into the diffusion barrier alloy film.

The Re—Cr alloy σ phase has a strong affinity with Cr, and tends to allow Cr in the metal base to be diffused into the diffusion barrier alloy film of the Re—Cr alloy σ phase. Cr is an element that is necessarily contained in a heat-resistant alloy base for corrosion resistance. Even if Cr is reduced in concentration by several %, it may still exhibit sufficient corrosion resistance. In recent years, however, there has been a trend to reduce the amount of added Cr from the standpoint of strength, and it has become the practice to add only a minimum amount, e.g., 5 to 10 weight %, of Cr. Therefore, if Cr is diffused from the heat-resistant alloy base into the coating layer (alloy film), the surface of the metal base suffers a lack of Cr, inviting a reduction in the corrosion resistance of the metal base and a reduction in the mechanical strength thereof due to a loss of phase stability.

In view of the above considerations, the diffusion barrier alloy film of the Re—Cr alloy σ phase remains to be improved depending on the application, the temperature range in which it is to be used, and the type of the base.

In the above-described Re—(Cr,Mo,W)—(Ni,Co,Fe) alloy film, Mo and W are elements that are congeneric to Cr. Since Mo and W are similar in property to Cr and have high melting points, if they are alloyed with an Re—Cr—(Ni,Co,Fe) alloy to produce an Re—(Cr,Mo,W)—(Ni,Co,Fe) alloy, then the resultant alloy will be expected to exhibit better diffusion barrier characteristics. However, an optimum alloy composition for W and Mo and the properties of an alloy film thereof have been unclear.

The present invention has been made under the foregoing circumstances. It is an object of the present invention to provide a diffusion barrier alloy film which has better diffusion barrier properties than an Re—Cr alloy film and which can stand usage at higher temperatures (e.g., 1150° C. or higher), a method of manufacturing such a diffusion barrier alloy film, and a high-temperature apparatus member incorporating such an alloy film.

In order to achieve the above object, the present invention provides a diffusion barrier alloy film having a diffusion barrier layer made of an Re—W alloy σ phase containing 12.5 to 56.5% of W in terms of atomic composition and the remainder of Re excluding unavoidable impurities.

The object of the present invention is to provide a heat-resistant, corrosion-resistant coating in the form of a diffusion barrier in order to use metal materials in sound conditions for a long period of time at ultra high temperatures of 1000° C. or higher. There has been proposed a diffusion barrier alloy film made essentially of an Re—Cr alloy σ phase, as a preferred example of such an alloy coating. Though the alloy film made of an Re—Cr alloy σ phase exhibits sufficient diffusion barrier properties at ultra high temperatures of 1000° C. or higher, it also suffers the following disadvantages:

1) Ni, Fe, Co, etc. are diffused from the metal base into the diffusion barrier alloy film and alloyed therewith, the melting point is lowered, and the diffusion barrier properties are slightly lowered.

2) When Cr is diffused from the metal base into the diffusion barrier alloy film, a Cr-depleted layer is developed in the metal base.

The diffusion barrier alloy film according to the present invention is made of an Re—W alloy σ phase, not an Re—Cr alloy σ phase. Since the melting point of W is 3410° C., the alloy W with Re is expected to have a melting point of about 3000° C. Accordingly, even when Ni, Fe, Co, etc. are diffused from the metal base into the diffusion barrier alloy film and alloyed therewith, a reduction in the melting point of the Re—W alloy σ phase is smaller than a reduction in the melting point of the Re—Cr alloy σ phase. Because W and Cr are congeneric to each other, it is expected that Cr is diffused from the metal base into the diffusion barrier layer of the Re—W alloy, developing a Cr-depleted layer in the metal base. However, the study made by the inventors has indicated that the Re—W alloy has a tendency to reject Cr. Specifically, with the diffusion barrier layer of the Re—W alloy being formed in the surface of the metal base which is primarily made of Ni, Fe, Co, etc., even when Ni, Fe, Co, etc. are diffused from the metal base into the diffusion barrier layer at high temperatures, the diffusion barrier properties are not impaired, and a Cr-depleted layer due to the diffusion of Cr from the metal base is not developed in the metal base.

The diffusion barrier layer needs to be of a composition effective to suppress the diffusion of Al that is harmful to the mechanical strength of the metal base and Ti, Ta that are harmful to keep the metal base resistant to oxidation, and needs to be able to be present stably for along period of time in contact with a oxidation-resistant Al-containing alloy layer and the metal base. Specifically, the diffusion barrier layer:

1) should be less permeable to Al, Ti, Ta; and 2) should have a positive value of Gibbs energy of the reaction between the Al-containing alloy layer and the metal base, or a small absolute value of Gibbs energy even if it is negative.

The diffusion barrier layer (alloy film) as a continuous layer made of an Re—W alloy σ phase containing 12.5 to 56.5% of W in terms of atomic composition and the remainder of Re excluding unavoidable impurities can satisfy the above requirements of a diffusion barrier.

The present invention provides another diffusion barrier alloy film having a diffusion barrier layer made essentially of an Re—W alloy σ phase containing 12.5 to 56.5% of W and 20 to 60% of Re in terms of atomic composition, the total quantity of W and Re being 50% or greater, and, excluding unavoidable impurities, the remainder being of at least one selected from Cr, Ni, Co, and Fe.

The alloy film of the above composition can also satisfy the above requirements of a diffusion barrier, as with the diffusion barrier layer described above.

The diffusion barrier layer of the diffusion barrier alloy film of the present invention is, for example, formed by performing Re or Re alloy plating and W or W alloy plating on a surface of a metal base, and thereafter heat-treating the plated metal base at 1200° C. or higher.

For example, if aqueous solution plating is employed for forming a plated layer in small holes, then Ni—W alloy plating is performed using an ammoniacal citric acid bath containing citric acid as a metal complexing agent for W alloy plating, with pH adjusted by the addition of ammonia, to form a diffusion barrier layer which is less susceptible to cracking and has a uniform film thickness.

Preferably, the diffusion barrier alloy film of the present invention further has an Re-dispersed layer with Re dispersed therein, disposed in an interface between the diffusion barrier layer and a metal base to be coated with the diffusion barrier layer.

With the Re-dispersed layer being inserted in the interface between the diffusion barrier layer and the metal base to be coated with the diffusion barrier layer, the bonding forces between the diffusion barrier layer and the metal base are increased, and a macro coefficient of linear expansion is of an intermediate value between those of the diffusion barrier layer and the metal base.

The Re-dispersed layer and the diffusion barrier layer may be formed by performing Re alloy plating in two stages with different concentrations of Re on a surface of the metal base, performing W alloy plating on the plated surface of the metal base, and thereafter heat-treating the plated metal base at 1200° C. or higher.

The diffusion barrier layer may have a surface coated with a diffusion alloy layer containing 10% or greater and less than 50% of Al, Cr, or Si in terms of atomic composition.

This makes it possible to produce gas turbines, jet engines, etc., which are capable of combustion at higher temperatures than heretofore and which have high thermal efficiency.

The diffusion barrier alloy film of the present invention may further have a W-dispersed layer with W dispersed therein, between the diffusion barrier layer and the diffusion alloy layer.

With the W-dispersed layer being inserted in the interface between the diffusion barrier layer and the diffusion alloy layer formed on the surface of the diffusion barrier layer, the inter-layer bonding forces between the diffusion barrier layer and the diffusion alloy layer are increased, and a macro coefficient of linear expansion is of an intermediate value between those of the diffusion barrier layer and the diffusion alloy layer.

The present invention provides a method of manufacturing a diffusion barrier alloy film having a diffusion barrier layer made of an Re—W alloy, comprising performing Re or Re alloy plating and W or W alloy plating on a surface of a metal base, and thereafter heat-treating the plated metal base at 1200° C. or higher.

The present invention provides another method of manufacturing a diffusion barrier alloy film having a diffusion barrier layer made of an Re-dispersed layer with Re dispersed therein and an Re—W alloy, comprising performing Re alloy plating in two stages on a surface of the metal base, performing W alloy plating on the plated surface of the metal base, and thereafter heat-treating the plated metal base at 1200° C. or higher.

The present invention provides another method of manufacturing a diffusion barrier alloy film, comprising forming a diffusion barrier layer made of an Re—W alloy on a surface of a metal base by fused-salt plating, and forming a diffusion alloy layer containing 10% or greater and less than 50% of Al, Cr, or Si in terms of atomic composition, on a surface of the diffusion barrier layer by fused-salt plating.

The present invention provides yet another method of manufacturing a diffusion barrier alloy film, comprising forming surface irregularities on a surface of a metal base, forming a diffusion barrier layer made of an Re—W alloy on the surface of the metal base on which the surface irregularities have been formed, forming surface irregularities on a surface of the diffusion barrier layer, and forming a corrosion-resistant alloy layer on the surface of the diffusion barrier layer on which the surface irregularities have been formed.

The present invention provides yet another method of manufacturing a diffusion barrier alloy film, comprising forming surface irregularities on a surface of a metal base, forming a diffusion barrier layer made of an Re—W alloy on the surface of the metal base on which the surface irregularities have been formed, forming surface irregularities on a surface of the diffusion barrier layer, and forming a wear-resistant layer on the surface of the diffusion barrier layer on which the surface irregularities have been formed.

The Re—W alloy is made of an Re—W alloy σ phase containing 12.5 to 56.5% of W in terms of atomic composition, for example, and the remainder of Re excluding unavoidable impurities.

The Re—W alloy may be made essentially of an Re—W alloy σ phase containing 12.5 to 56.5% of W and 20 to 60% of Re in terms of atomic composition, the total quantity of W and Re being 50% or greater, and, excluding unavoidable impurities, the remainder being of at least one selected from Cr, Ni, Co, and Fe.

After the metal base is heat-treated, Al, Cr, or Si may be diffused to form a diffusion alloy layer on the surface of the diffusion barrier layer.

The surface of the metal base may be plated with Cr in advance.

The surface of the metal base is thus supplemented with Cr. Therefore, when a metal base containing less than 10% of Cr is used, a Cr-depleted layer is prevented from being developed in the surface of the metal base due to the diffusion of Cr.

The present invention provides a high-temperature apparatus member comprising a metal base having a surface coated with a diffusion barrier layer made of an Re—W alloy σ phase containing 12.5 to 56.5% of W in terms of atomic composition and the remainder of Re excluding unavoidable impurities.

The present invention provides another high-temperature apparatus member comprising a metal base having a surface coated with a diffusion barrier layer made essentially of an Re—W alloy σ phase containing 12.5 to 56.5% of W and 20 to 60% of Re in terms of atomic composition, the total quantity of W and Re being 50% or greater, and, excluding unavoidable impurities, the remainder being of at least one selected from Cr, Ni, Co, and Fe.

Preferably, the diffusion barrier layer has a surface coated with a diffusion alloy layer containing 10% or greater and less than 50% of Al, Cr, or Si in terms of atomic composition.

The diffusion barrier alloy film of the present invention has a diffusion barrier capability that is effective at a high temperature of 1000° C. or higher or even at 1150° C. or higher. It is known that an alumina film exhibits good oxidation resistance in such a high temperature range. For maintaining a sound alumina film over a long period of time, it is necessary for Al of 10 atomic % or the higher to be present on the surface of the member (metal base). Furthermore, the alumina film needs to be of a composition having small reactivity with the diffusion barrier layer of the Re—W alloy σ phase, and hence the concentration of Al in the alumina film needs to be less than 50 atomic %. Therefore, the concentration of Al in the diffusion alloy layer, which comprises an Al-rich layer, for example, deposited on the surface of the diffusion barrier layer should preferably be of 10 atomic % or higher and less than 50 atomic %. In particular, if the metal base is of an Ni—Al alloy or an Ni—Al—Pt alloy, then it is transformed if the concentration of Al is unduly reduced. It is not preferable that the concentration of Al in the diffusion alloy layer be 50 atomic % or higher.

The high-temperature apparatus member may further have an Re-dispersed layer with Re dispersed therein, between the metal base and the diffusion barrier layer, and may further have a W-dispersed layer with W dispersed therein, between the diffusion barrier layer and the diffusion alloy layer.

The diffusion alloy layer may have a surface covered with a ceramics layer. The diffusion barrier layer may have a surface coated with a heat-resistant alloy film or a wear-resistant film.

According to the present invention, since the surface of the metal base is coated with a diffusion barrier layer made essentially of an Re—W alloy σ phase, and, if required, the surface of the diffusion barrier layer is coated with an Al-containing alloy layer (diffusion alloy layer) containing 10 atomic % or higher and less than 50 atomic % of Al, the high-temperature apparatus member remains corrosion-resistant for a long period of time at ultrahigh temperatures. Therefore, the service life of the high-temperature apparatus member is extended for a longer period of time than if the conventional Re—Cr—(—Ni) alloy film is employed. In addition, since the diffusion of Cr from the metal base is eliminated, a Cr-depleted layer is prevented from being developed in the surface of the metal base. Accordingly, the diffusion barrier alloy film can finds use in a wider range of more applications.

By fabricating the diffusion barrier layer of an Re—W alloy σ phase through a process based on a combination of an Re or Re alloy plating process or a W or W alloy plating process and heat-treating process, it is possible to easily form an alloy film as a defect-free continuous layer of uniform thickness.

DETAILED DESCRIPTION OF THE INVENTION

Embodiments of the present invention will be described below with reference to the drawings.

Figure 1A:
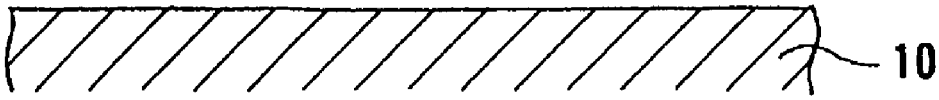
FIGS. 1A through 1C are views showing successive steps of fabricating a high-temperature apparatus member having a diffusion barrier alloy film according to an embodiment of the present invention.
Figure 1B:
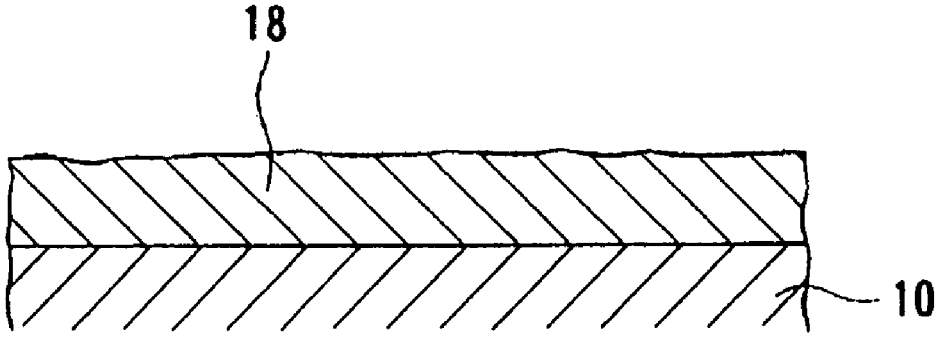
Figure 1C:
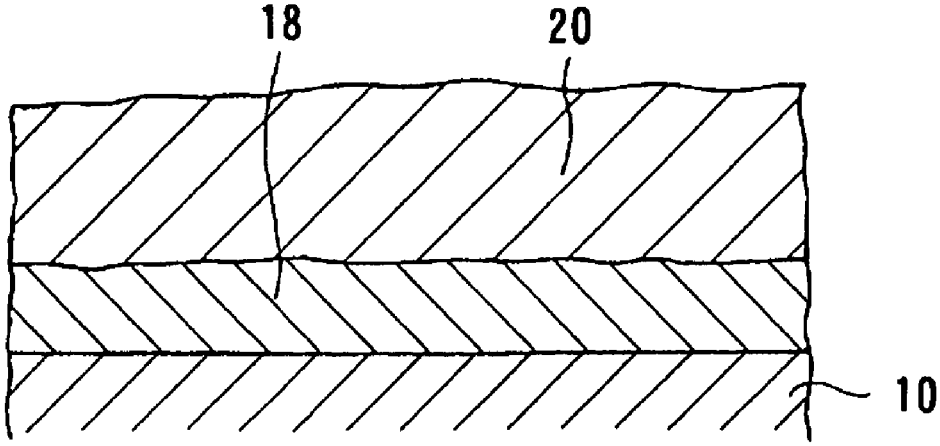

FIGS. 1A through 1C show successive steps of fabricating a high-temperature apparatus member having a diffusion barrier alloy film according to an embodiment of the present invention. First, as shown in FIG. 1A, a metal base 10 made of an Ni-base alloy and serving as a base of a high-temperature apparatus member is prepared. The metal base 10 made of an Ni-base alloy may be any of almost all Ni—Cr heat-resistant alloys. For example, these Ni—Cr heat-resistant alloys include Hastelloy X and Hanes 230 which are Ni-20% Cr alloys, Inconel 625, Waspaloy, Inconel 718, Inconel 738, and Mar-M247, CMSX-4, CMSX-10, and TMS-138 which are Ni—Cr—Al alloys and used for turbine blades and vanes, and Ni-40% Cr—W cast alloys.

In addition to the Ni-base alloy, a Co-base alloy or an Fe-base alloy may be used as the material of the metal base 10.

As shown in FIG. 1B, a diffusion barrier layer (Re—W(M) alloy layer) 18 comprising an Re—W alloy σ phase which contains 12.5 to 56.5% of W in terms of atomic composition and the remainder of Re excluding unavoidable impurities, and serving as a diffusion barrier alloy film is then formed on a surface of the metal base 10. The unavoidable impurities M are mainly Ni if the metal base 10 is made of an Ni-base alloy. The unavoidable impurities X also include Cr, Fe, Mo, Co, etc. in addition to Ni.

The diffusion barrier layer 18, which serves as a diffusion barrier alloy film, may be essentially of an Re—W alloy σ phase containing 12.5 to 56.5% of W and 20 to 60% of Re in terms of atomic composition, the total quantity of W and Re being 50% or greater, and excluding unavoidable impurities, the remainder being of at least one selected from Cr, Ni, Co, and Fe.

Since the melting point of W is 3410° C., the alloy W with Re is expected to have a melting point of about 3000° C. With the diffusion barrier alloy film comprising the diffusion barrier layer 18 of the Re—W alloy σ phase, even when Ni, Fe, Co, etc. are diffused from the metal base 10 into the diffusion barrier layer 18 and alloyed therewith, a reduction in the melting point of the diffusion barrier layer 18 is smaller and the diffusion barrier properties are less impaired than if the diffusion barrier layer (diffusion barrier alloy film) is of an Re—Cr alloy σ phase. Though W and Cr are congeneric to each other, since the Re—W alloy has a tendency to reject Cr, a Cr-depleted layer due to the diffusion of Cr will not be developed in the metal base 10 when the high-temperature apparatus member is used at high temperatures.

Furthermore, the diffusion barrier layer 18 of the Re—Cr alloy σ phase having the above composition is capable of preventing the diffusion of Al that is harmful to the mechanical strength of the metal base 10 and the diffusion of Ti, Ta that are harmful to keeping the metal base 10 resistant to oxidation, and of existing stably for a long period of time while in contact with an oxidation-resistant diffusion alloy layer (Al-containing alloy layer) 20 to be described below and the metal base 10, and satisfies the requirements to be fulfilled by a diffusion barrier.

Then, if required, as shown in FIG. 1C, the surface of the metal base 10 with the diffusion barrier layer 18 formed thereon is coated with a diffusion alloy layer 20 containing Al, Cr, or Si in a range equal to or greater than 10% and less than 50% in terms of atomic composition, thereby providing a coating layer made up of the diffusion barrier layer 18 and the diffusion alloy layer 20.

The diffusion barrier layer 18 has a diffusion barrier capability that is effective at a high temperature of 1000° C. or higher or even at 1150° C. or higher. It is known that an alumina film exhibits good oxidation resistance in such a high temperature range. For maintaining a sound alumina film over a long period of time, it is necessary for Al of 10 atomic % or higher to be present on the surface of the metal base 10. Furthermore, as described above, the alumina film needs to be of a composition having small reactivity with the diffusion barrier layer 18 of the Re—W alloy σ phase, and hence the concentration of Al needs to be less than 50 atomic %. Therefore, the concentration of Al in the diffusion alloy layer 20, which comprises an Al-containing alloy layer, for example, deposited on the surface of the diffusion barrier layer 28 should preferably be of 10 atomic % or higher and less than 50 atomic %. In particular, if the metal base 10 is of an Ni—Al alloy or an Ni—Al—Pt alloy, then it is transformed if the concentration of Al is unduly reduced. It is therefore not preferable that the concentration of Al in the diffusion alloy layer 20 be 50 atomic % or higher.

Examples of processes of fabricating the high-temperature apparatus member shown in FIGS. 1A through 1C will be described below concretely.

(1) The Formation of a Film According to a Physical Process Such as Spraying, PVD, Sputtering, or the Like:

The diffusion barrier layer 18 made of an Re—W alloy and serving as a diffusion barrier alloy film is formed on the surface of the metal base 10 from a prepared Re—W alloy powder according to a spraying process. The diffusion barrier layer 18 may remain untreated. Preferably, however, the diffusion barrier layer 18 is heat-treated in a vacuum at a temperature of 1200° C. or higher to bring itself into close contact with the metal base 10. At this time, though Ni, Co, Fe, etc. are diffused from the metal base 10 into the diffusion barrier layer 18, the diffusion barrier properties of the diffusion barrier layer 18 are not lowered.

Alternatively, the Re—W alloy powder may not be used, but an Re powder and a W powder may be deposited by a spraying process, and thereafter the assembly may be heat-treated under the above conditions to produce the same diffusion barrier layer 18 serving as a diffusion barrier alloy film.

After the diffusion barrier layer 18 is formed on the surface of the metal base 10, the diffusion alloy layer 20 comprising an Al (or Si, Cr)-containing alloy film is formed on the surface of the diffusion barrier layer 18 using an Al (or Si, Cr) alloy powder, selected depending on the temperature at which and the environment in which the high-temperature apparatus member is to be used, by a spraying process.

The spraying process referred to above may be replaced with a PVD process or a sputtering process to produce the same diffusion barrier layer 18 and diffusion alloy layer 20.

(2) The Formation of a Film According to a Combination of Aqueous Solution Plating and Diffusion:

A combination of aqueous solution plating and diffusion is preferable for inexpensively forming the diffusion barrier layer 18 serving as a diffusion barrier alloy film on the metal base (component) 10 which has a complex shape having small holes and the like. Specifically, an Re or Re alloy film is formed by Re or Re alloy aqueous solution plating on the surface of the metal base 10 made of a Ni-, Co-, or Fe-base alloy, and thereafter a W or W alloy film is formed on the surface of the Re or Re alloy film by W or W alloy aqueous solution plating. The plated metal base 10 is then heat-treated in a vacuum or an inactive atmosphere at 1200° C. or higher, thereby forming the diffusion barrier layer 18 having a uniform composition and thickness.

Furthermore, the surface of the diffusion barrier layer 18 is plated with Ni (or Fe, Co), and Al (or Cr, Si) is diffused to form the diffusion alloy layer 20 comprising an Al (or Si, Cr)-containing alloy film.

(3) The Formation of a Film with Fused-Salt Plating:

Almost all elements can be plated according to fused-salt plating. Since fused-salt plating is generally performed at high temperatures, a heat-treating can be dispensed with. Therefore, fused-salt plating is advantageous in terms of process and economy. Specifically, the surface of the metal base 10 made of a Ni-, Co-, or Fe-base alloy is plated with Re by fused-salt plating, using a chloride or fluoride bath, for example. Thereafter, the surface of plated Re is plated with W by fused-salt plating, using a halide bath, for example. The plated layer directly serves as the diffusion barrier layer 18 which provides a diffusion barrier alloy film. More preferably, the plated metal base 10 is heat-treated in a vacuum or an inactive atmosphere at 1200° C. or higher, forming the diffusion barrier layer 18 having a uniform composition on the surface of the metal base 10.

Furthermore, the surface of the diffusion barrier layer 18 is plated with Ni (or Fe, Co) and Al (or Cr, Si) by fused-salt plating to form the diffusion alloy layer 20 comprising an Al (or Si, Cr)-containing alloy film.

Any of the processes (1) through (3) described above may be partly employed. For example, the diffusion barrier layer 18 may be fabricated by a combination of aqueous solution plating and heat-treatment, and the diffusion alloy layer 20 comprising an Al (or Si, Cr)-containing alloy film may be fabricated by spraying. These processes may freely be selected depending on the composition of the metal base 10, the shape of the component, the cost thereof, and the like.

Example

A strip specimen of an Ni-base alloy (CMSX-4) was used as a metal base. A surface of a metal base (specimen) was ground by SiC#240 and degreased for use in the test. In order to process the specimen into a component having a complex shape, a process according to a combination of aqueous solution plating and diffusion was employed. First, the specimen was plated with an Re—Ni alloy at a current density of 0.1 A/cm$^2$ for 30 minutes using an Re—Ni alloy plating bath in the form of an ammoniacal citric acid bath having the bath composition shown below. Thereafter, the specimen was plated with a W—Ni alloy at a current density of 0.1 A/cm$^2$ for 30 minutes using a W—Ni alloy plating bath in the form of an ammoniacal citric acid bath having the bath composition shown below. Thereafter, the specimen was heat-treated in a vacuum of $10^{-3}$ Pa at 1300° C. for 10 hours. The heat-treated specimen was plated with Ni at a current density of 5 mA/cm$^2$ for 60 minutes, using a Watts nickel bath, after which Al was diffused into the specimen at 900° C. for 5 hours in a mixed powder of NiAl and $Al_2O_3$.

Re—Ni alloy plating bath:
- Perrhenic acid ion: 0.1 mol/L
- Nickel sulfate: 0.1 mol/L
- Citric acid: 0.1 mol/L
- pH=8 (adjusted with ammonia water)
- Bath temperature: 50° C.

Ni—W alloy plating bath:
- Sodium tungstate: 0.2 mol/L
- Nickel sulfate: 0.1 mol/L
- Citric acid: 0.4 mol/L
- pH=6 (adjusted with ammonia water)
- Bath temperature: 70° C.

Figure 2:
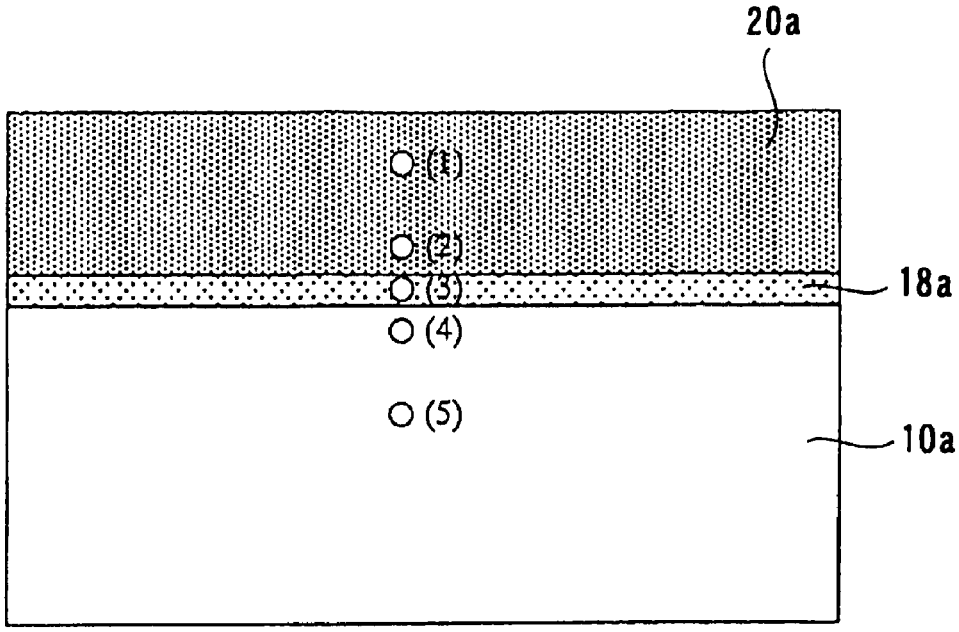
FIG. 2 is a view schematically showing a specimen section after Al has been diffused in Example.

A section of the treated specimen is shown in FIG. 2. Results of an elemental analysis at the points in the section shown in FIG. 2 are given in Table 1. (1) through (5) in Table 1 correspond respectively to (1) through (5) in FIG. 2.

TABLE 1

| | (1) | (2) | (3) | (4) | (5) |
|---|---|---|---|---|---|
| Re | 0.0 | 0.0 | 42.0 | 1.2 | 1.0 |
| Ni | 56.0 | 55.5 | 15.0 | 64.0 | 64.2 |
| Cr | 1.0 | 1.1 | 3.0 | 7.0 | 7.2 |
| Co | 3.0 | 4.0 | 3.0 | 9.0 | 9.0 |
| W | 0.0 | 0.0 | 36.0 | 2.2 | 2.1 |
| Mo | 0.0 | 0.0 | 1.0 | 0.4 | 0.4 |
| Ta | 0.0 | 0.0 | 0.0 | 2.2 | 2.2 |
| Al | 40.0 | 39.4 | 0.0 | 12.7 | 12.5 |
| Ti | 0.0 | 0.0 | 0.0 | 1.3 | 1.4 |
| O | 0.0 | 0.0 | 0.0 | 0.0 | 0.0 |
| Total | 100.0 | 100.0 | 100.0 | 100.0 | 100.0 |

As can be seen from FIG. 2, a diffusion barrier layer 18*a* comprising a 42 atomic % Re-36 atomic % W alloy layer (the remainder including few % of each of Ni, Co, Cr, Mo) is formed on a surface of a metal base (Ni-base alloy base) 10*a*, and a diffusion alloy layer 20*a* comprising an Ni-40 atomic % Al alloy film (the remainder including a few % of each of Co, Cr) is formed on a surface of the diffusion barrier layer 18*a*. Almost no Al is diffused in the metal base 10*a*. It can be seen that the concentration of Cr in the metal base 10*a* is about 7% both near the surface of the metal base 10*a* and within the metal base 10*a*, indicating that no Cr-depleted layer is formed therein. The diffusion barrier layer 18*a* and the diffusion alloy layer 20*a* are continuous layers having a substantially uniform composition and thickness over the entire surface of the specimen.

Figure 3:
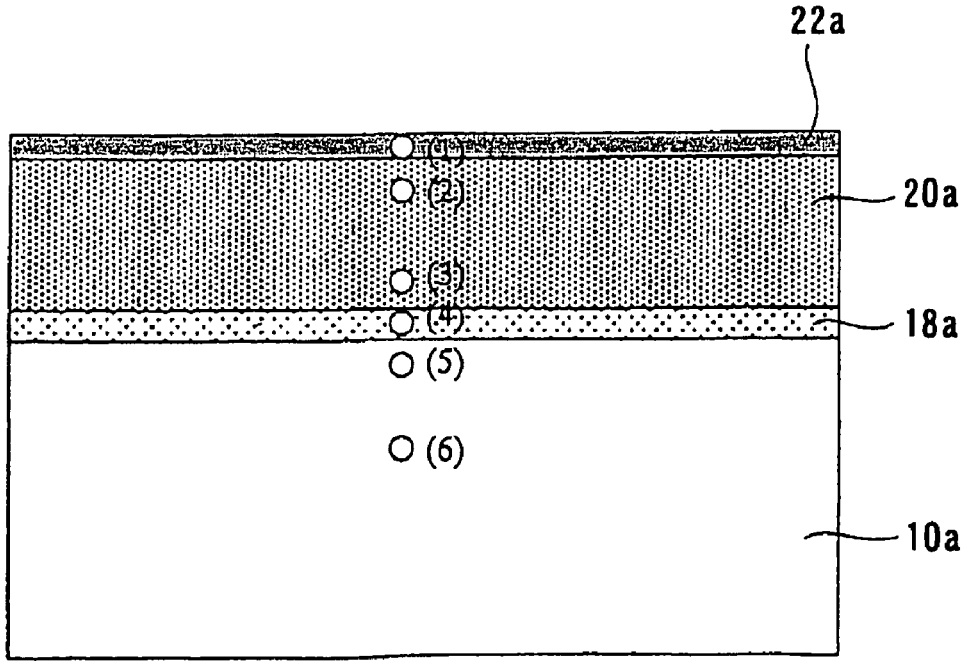
FIG. 3 is a view schematically showing a specimen section after the specimen has been oxidized for two weeks in the atmosphere at 1150° C. in Example.

A section of the specimen after it was oxidized in the atmosphere at 1150° C. for two weeks is shown in FIG. 3. Results of an elemental analysis at the points in the section shown in FIG. 3 are given in Table 2. (1) through (6) in Table 2 correspond respectively to (1) through (6) in FIG. 3.

TABLE 2

| | (1) | (2) | (3) | (4) | (5) | (6) |
|---|---|---|---|---|---|---|
| Re | 0.0 | 0.0 | 0.0 | 42.2 | 1.1 | 1.0 |
| Ni | 0.0 | 56.4 | 56.0 | 13.5 | 63.8 | 64.2 |
| Cr | 0.0 | 1.1 | 1.0 | 2.0 | 7.1 | 7.2 |
| Co | 0.0 | 4.0 | 4.5 | 4.4 | 9.2 | 9.0 |
| W | 0.0 | 0.0 | 0.1 | 37.0 | 2.2 | 2.1 |
| Mo | 0.0 | 0.0 | 0.0 | 0.9 | 0.4 | 0.4 |
| Ta | 0.0 | 0.0 | 0.0 | 0.0 | 2.2 | 2.2 |
| Al | 40.2 | 38.5 | 38.4 | 0.0 | 12.7 | 12.5 |
| Ti | 0.0 | 0.0 | 0.0 | 0.0 | 1.3 | 1.4 |
| O | 59.8 | 0.0 | 0.0 | 0.0 | 0.0 | 0.0 |
| Total | 100.0 | 100.0 | 100.0 | 100.0 | 100.0 | 100.0 |

As shown in FIG. 3, an alumina film ($Al_2O_3$) 22*a* having a thickness of a few microns was present in a surface of a diffusion alloy layer 20*a*. The concentration of Al in the diffusion alloy layer (Al-containing alloy layer) 20*a* directly below the alumina film 22*a* was 38.5 atomic %, and a diffusion barrier layer 18*a* directly below the diffusion alloy layer 20*a* comprised an about 42.2 atomic % Re-37.0 atomic % W alloy layer (the remainder including few % of each of Ni, Co, Cr, Mo) which was the same as prior to the oxidization. Almost no Al is diffused in the metal base 10*a*.

It should be noted that Ni and Cr each contained in the diffusion barrier layer 18*a* by a few % prior to the oxidization tend to be slightly reduced after the oxidization. Specifically, it is understood that, at an ultrahigh temperature of 1150° C., an Re—W binary alloy is essentially stabler and more excellent as a diffusion barrier than a material containing a few % of Cr, Ni. It is also understood that Cr tends to be excluded from the Re—W alloy layer as the diffusion barrier layer 18*a*, and the surface of the metal base 10*a* is essentially not liable to form a Cr-depleted layer.

Comparative Example

A strip specimen of an Ni-base alloy (CMSX-4) was used as a metal base. A surface of a metal base (specimen) was ground by SiC#240 and degreased for use in the test. First, the specimen was plated with an Re—Ni alloy at a current density of 0.1 A/cm$^2$ for 30 minutes using a highly concentrated Re—Ni alloy plating bath having the bath composition shown below. Thereafter, the specimen was embedded in a Cr+$Al_2O_3$ powder, and then heat-treated in a vacuum of $10^{-3}$ Pa at 1100° C. for 5 hours. The heat-treated specimen was plated with Ni at a current density of 5 mA/cm$^2$ for 60 minutes, using the Watts nickel bath, after which Al was diffused into the specimen at 900° C. for 5 hours in a mixed powder of NiAl and $Al_2O_3$.

Highly concentrated Re—Ni alloy plating bath:

Perrhenic acid ion: 0.1-0.8 mol/L

Total amount of Ni ions: 0.005-2.0 mol/L

Cr(III) ion: 0.1-4.0 mol/L

Total amount of Li ions and/or Na ions: 0.0001-5.0 mol/L or less pH=0-8

Bath temperature: 10-80° C.

Figure 4:
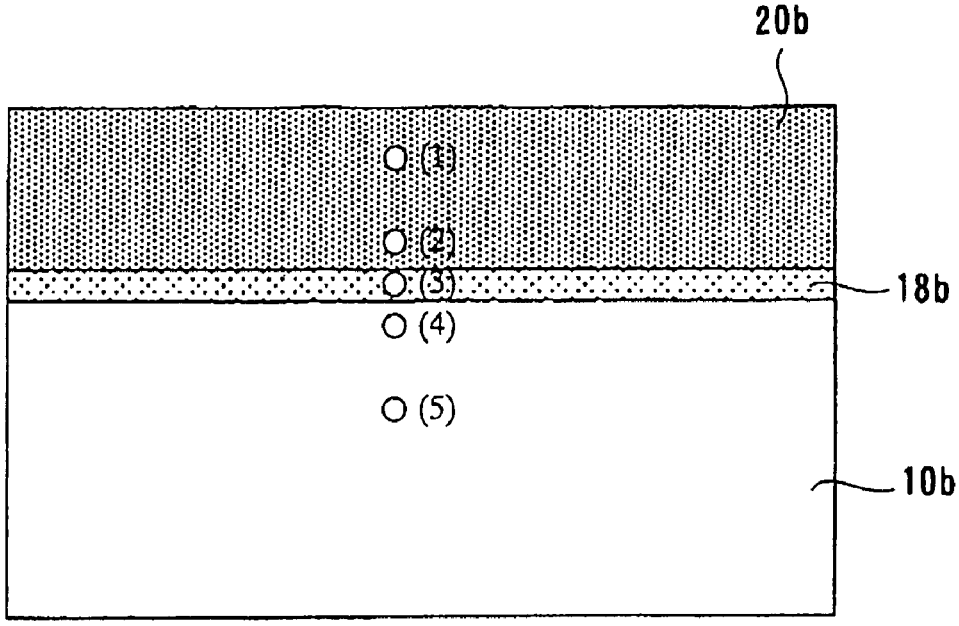
FIG. 4 is a view schematically showing a specimen section after Al has been diffused in Comparative Example.

A section of the treated specimen is shown in FIG. 4. Results of an elemental analysis at the points in the section shown in FIG. 4 are given in Table 3. (1) through (5) in Table 3 correspond respectively to (1) through (5) in FIG. 4.

TABLE 3

| | (1) | (2) | (3) | (4) | (5) |
|---|---|---|---|---|---|
| Re | 0.0 | 0.0 | 40.0 | 1.2 | 1.0 |
| Ni | 52.5 | 51.6 | 17.0 | 65.9 | 64.2 |
| Cr | 4.5 | 5.0 | 40.0 | 6.0 | 7.2 |
| Co | 3.0 | 4.0 | 3.0 | 9.0 | 9.0 |
| W | 0.0 | 0.0 | 0.0 | 1.8 | 2.1 |
| Mo | 0.0 | 0.0 | 0.0 | 0.3 | 0.4 |
| Ta | 0.0 | 0.0 | 0.0 | 2.0 | 2.2 |
| Al | 40.0 | 39.4 | 0.0 | 12.5 | 12.5 |
| Ti | 0.0 | 0.0 | 0.0 | 1.3 | 1.4 |
| O | 0.0 | 0.0 | 0.0 | 0.0 | 0.0 |
| Total | 100.0 | 100.0 | 100.0 | 100.0 | 100.0 |

As shown in FIG. 4, a diffusion barrier layer 18*b* comprising a 40 atomic % Re-40 atomic % Cr-17 atomic % Ni alloy layer (the remainder including a few % of Co) is formed on a surface of a metal base (Ni-base alloy base) 10*b*, and a diffusion alloy layer 20*b* comprising an Ni-39.4 atomic % Al alloy layer (the remainder including few % of each of Co, Cr) is formed on a surface of the diffusion barrier layer 18*b*. It can be seen that almost no Al is diffused into the metal base 10*b*, but the concentration of Cr in the metal base 10*b* near the diffusion barrier layer 10*b* is slightly smaller than the bulk concentration in the metal base 10*b*.

Figure 5:
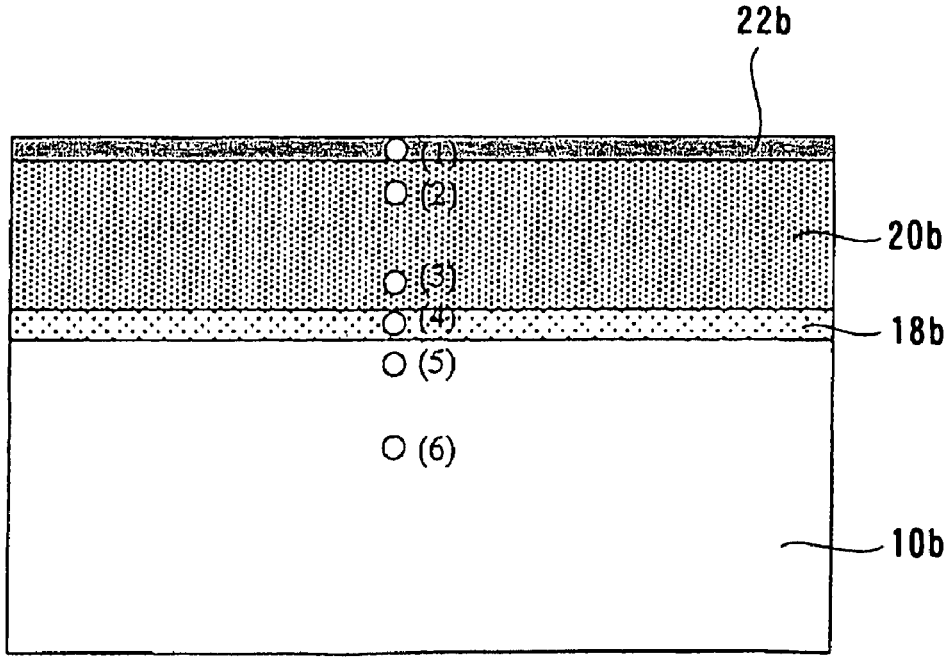
FIG. 5 is a view schematically showing a specimen section after the specimen has been oxidized for two weeks in the atmosphere at 1150° C. in Comparative Example.

A section of the specimen after it was oxidized in the atmosphere at 1150° C. for two weeks is shown in FIG. 5. Results of an elemental analysis at the points in the section shown in FIG. 5 are given in Table 4. (1) through (6) in Table 4 correspond respectively to (1) through (6) in FIG. 5.

TABLE 4

| | (1) | (2) | (3) | (4) | (5) | (6) |
|---|---|---|---|---|---|---|
| Re | 0.0 | 0.0 | 0.0 | 38.0 | 1.1 | 1.0 |
| Ni | 0.0 | 54.4 | 54.0 | 16.4 | 65.1 | 63.2 |
| Cr | 0.0 | 5.1 | 5.4 | 41.0 | 5.0 | 7.2 |
| Co | 0.0 | 4.0 | 4.5 | 4.6 | 9.2 | 9.0 |
| W | 0.0 | 0.0 | 0.1 | 0.0 | 2.0 | 2.1 |
| Mo | 0.0 | 0.0 | 0.0 | 0.0 | 0.4 | 0.4 |
| Ta | 0.0 | 0.0 | 0.0 | 0.0 | 2.2 | 2.2 |
| Al | 40.0 | 36.5 | 36.0 | 0.0 | 13.7 | 13.5 |
| Ti | 0.0 | 0.0 | 0.0 | 0.0 | 1.3 | 1.4 |
| O | 60.0 | 0.0 | 0.0 | 0.0 | 0.0 | 0.0 |
| Total | 100.0 | 100.0 | 100.0 | 100.0 | 100.0 | 100.0 |

As shown in FIG. 5, an alumina film ($Al_2O_3$) 22*b* having a thickness of a few microns is present in a surface of a diffusion alloy layer 20*b*, as with the Example shown in FIG. 3. In the Example in FIG. 3, the concentration of Al in the diffusion alloy layer (Al-containing alloy layer) 20*a* was 38.4-38.5 atomic % after the oxidization. In the diffusion alloy layer (Al-containing alloy layer) 20*b* according to the Comparative Example, in contrast, the concentration of Al is reduced to 35.0 to 35.5 atomic %. According to the Comparative Example, furthermore, it can be seen that a Cr-depleted layer remains to be formed after the oxidization and the concentration of Al is slightly increased directly below the diffusion barrier layer 18*b*.

As described above, even the diffusion barrier layer 18*b* of an Re—Cr—Ne alloy has diffusion barrier properties at 1150° C. However, a Cr-depleted layer is formed directly below the diffusion barrier layer 18*b*, and the concentration of Al is slightly lowered in the diffusion alloy layer (Al-containing alloy layer) 20*b* and Al is slightly diffused therefrom into the metal base 10*b*. In contrast, these phenomena are not observed with the diffusion barrier layer 18*a* of an Re—W alloy according to the present invention, indicating that the diffusion barrier layer 18*a* is a better diffusion barrier.

Figure 6:
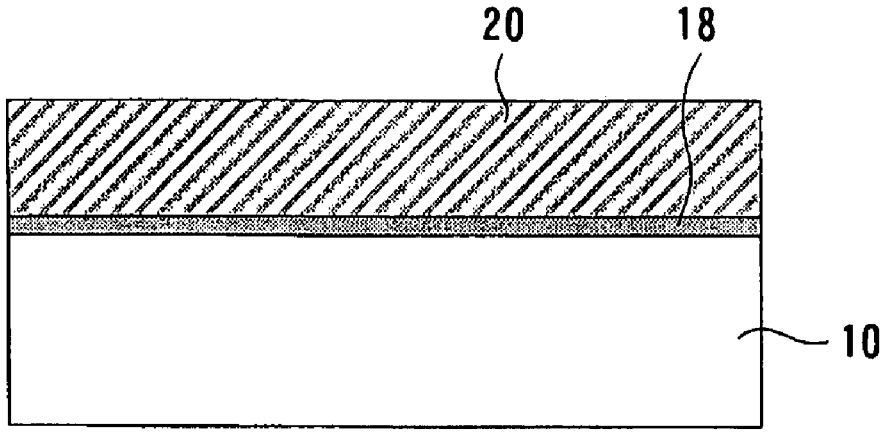
FIG. 6 is a view schematically showing a cross section of a high-temperature apparatus member having a diffusion barrier alloy film according to another embodiment of the present invention.
Figure 7:
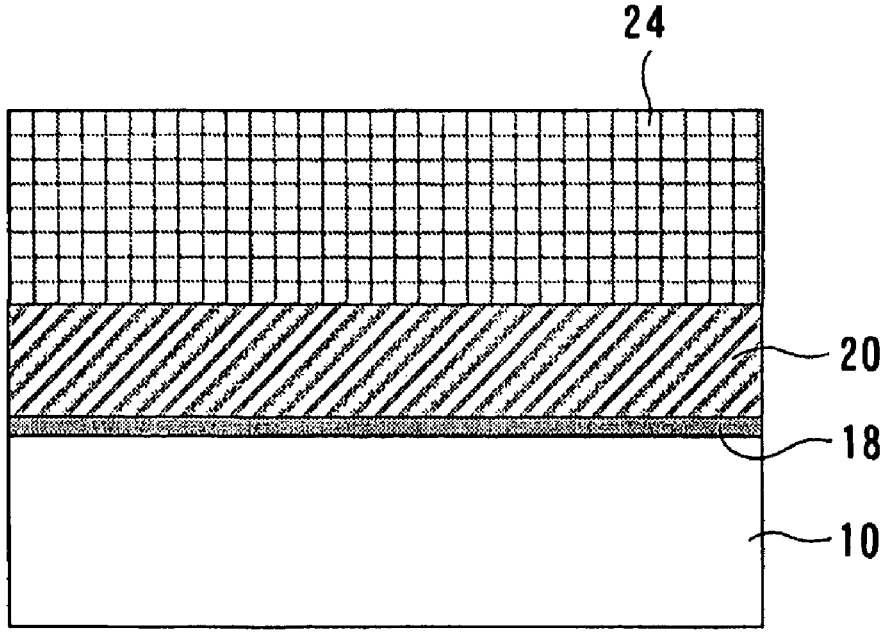
FIG. 7 is a view schematically showing a cross section of the high-temperature apparatus member illustrated in FIG. 6 with a ceramics layer formed on a surface thereof.

In the above example, as shown in FIG. 6, the surface of the metal base 10 made of an Ni-base alloy, for example, is coated with a diffusion barrier layer (Re—W(M) alloy layer) 18 serving as a diffusion barrier alloy film, and, if necessary, the surface of the diffusion barrier layer 18 is coated with a diffusion alloy layer 20 comprising an Ni—Al(X) alloy layer (X=Zr, Y, Si), for example, producing a high-temperature apparatus member. Furthermore, if required, as shown in FIG. 7, a $ZrO_2$ ceramics coating (so-called heat shield coating), for example, may be applied to the surface of the diffusion alloy layer 20 to form a ceramics layer 24 made of $ZrO_2$ ceramics having a low coefficient of thermal conductivity.

The ceramics layer 24 has a thickness in the range from 100 to 400 μm, for example. The ceramics layer 24 makes it possible to produce gas turbines, jet engines, etc., which are capable of combustion at higher temperatures than heretofore and which have high thermal efficiency.

Figure 8A:
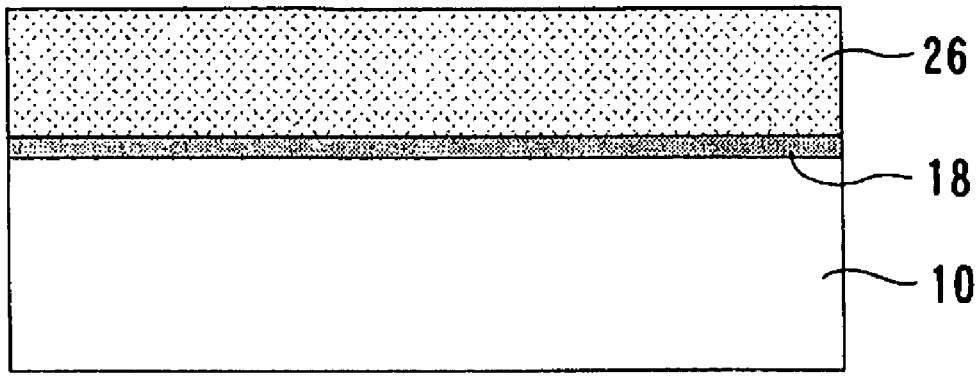
FIG. 8A is a view schematically showing a cross section of a modification of the high-temperature apparatus member illustrated in FIG. 6 with an Ni (Cr) alloy layer formed on a surface of a diffusion barrier layer.
Figure 8B:
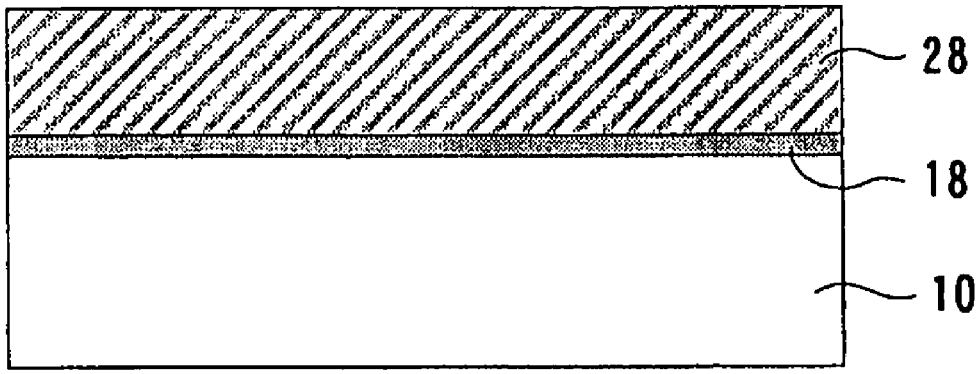
FIG. 8B is a view schematically showing a cross section of a modification of the high-temperature apparatus member illustrated in FIG. 6 with a diffusion alloy layer in the form of an Ni(Cr)—Al(X) alloy layer formed on the surface of a diffusion barrier layer.

As shown in FIG. 8A, an Ni (Cr) alloy layer 26 may be formed in advance on the surface of the diffusion barrier layer 18 thereby to coat the surface of the diffusion barrier layer 18 with a diffusion alloy layer 28 in the form of an Ni(Cr)—Al (X) alloy layer, for example, as shown in FIG. 8B.

Figure 9:
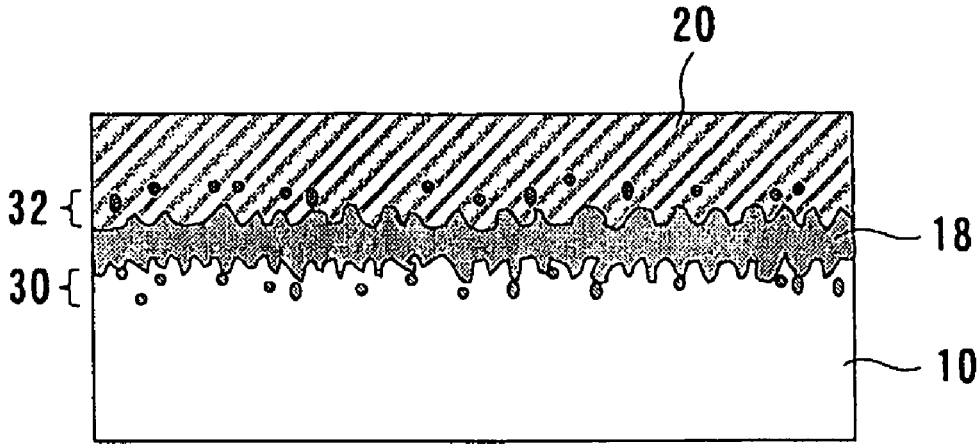
FIG. 9 is a view schematically showing a cross section of a high-temperature apparatus member having a diffusion barrier alloy film according to yet another embodiment of the present invention.

FIG. 9 shows a high-temperature apparatus member having a diffusion barrier alloy film according to another embodiment of the present invention. According to this embodiment, an Re-dispersed layer 30 where Re is dispersed, a diffusion barrier layer (Re—W(M) alloy layer) 18, and a W-dispersed layer 32 where W is dispersed are successively formed on the surface of the metal base 10 of an Ni-base alloy or the like, and a surface of the W-dispersed layer 32 is coated with a diffusion alloy layer 20 comprising an Ni—Al(X) alloy layer (X=Zr, Y, Si). By employing a so-called "wedge structure" wherein the Re-dispersed layer 30 is interposed between the metal base 10 and the diffusion barrier layer 18 and the W-dispersed layer 32 is interposed between the diffusion barrier layer 18 and the diffusion alloy layer 20, giving an "anchor effect" to the Re-dispersed layer 30 and the W-dispersed layer 32, the bonding forces between the metal base 10 and the diffusion barrier layer 18 and between the diffusion barrier layer 18 and the diffusion alloy layer 20 are increased, and a macro coefficient of linear expansion is of an intermediate value between those of the layers.

The Re-dispersed layer 30 comprises a layer having a thickness ranging from 1 to 100 μm wherein Re particles having diameters in the range from 0.1 to 20 μm are dispersed at a volume ratio in the range from 10 to 80%, for example. The W-dispersed layer 32 comprises a layer having a thickness ranging from 10 to 100 μm wherein W particles having diameters in the range from 1 to 20 μm are dispersed at a volume ratio in the range from 20 to 80%, for example.

The Re-dispersed layer 30, the diffusion barrier layer 18, and the W-dispersed layer 32 can be formed by successively performing first Re—Ni alloy plating where Re is of a low concentration (25 to 40 atomic %) and second Re— Ni alloy plating where Re is of a high concentration (65 to 90 atomic %), and thereafter performing W—Ni alloy plating, Ni plating, and W—Ni alloy plating, followed by heat-treatment. This is because the low-concentration Re—Ni layer adjacent to the metal base 10 is separated into two phases, i.e., an Ni phase with a solid solution of Re and an Re phase with a solid solution of Ni, and the Ni—W layer adjacent to the diffusion alloy layer 20 is separated into an Ni phase with a solid solution of W and a W phase with a solid solution of Ni.

Figure 10:
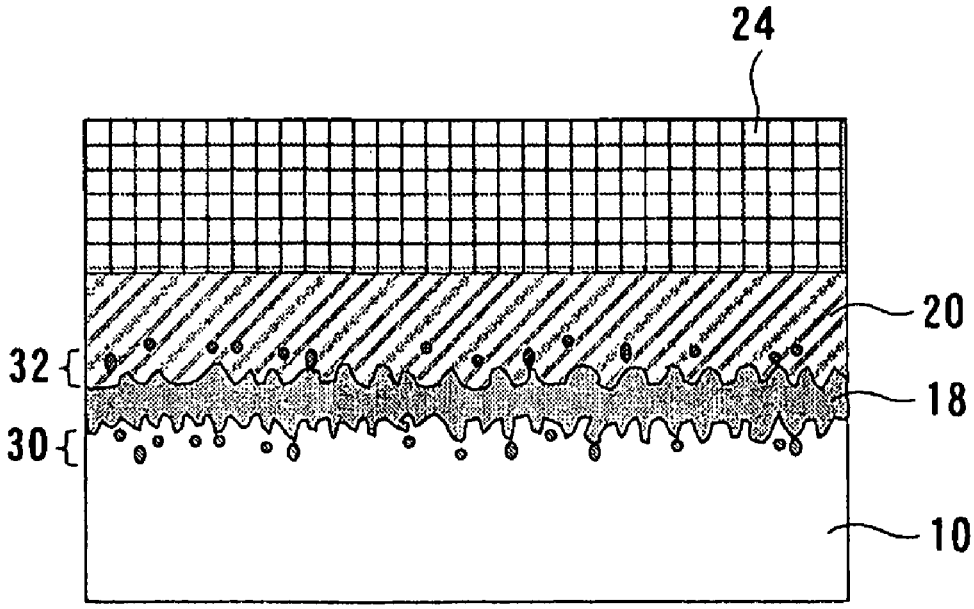
FIG. 10 is a view schematically showing a cross section of the high-temperature apparatus member shown in FIG. 9 with a ceramics layer formed on the surface thereof.

Furthermore, if required, as shown in FIG. 10, a $ZrO_2$ ceramics coating (so-called heat shield coating), for example, may be applied to the surface of the diffusion alloy layer 20 to form a ceramics layer 24 made of $ZrO_2$ ceramics having a thickness in the range from 100 to 400 μm, for example. The ceramics layer 24 makes it possible to produce gas turbines, jet engines, etc., which are capable of combustion at higher temperatures than heretofore and which have high thermal efficiency.

Figure 11:
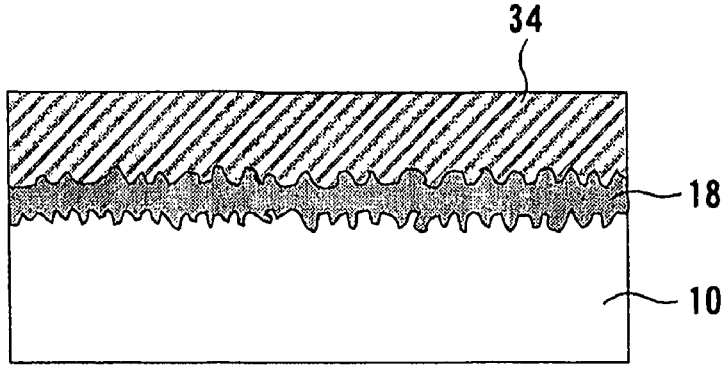
FIG. 11 is a view schematically showing a cross section of a high-temperature apparatus member having a diffusion barrier alloy film according to yet another embodiment of the present invention.

FIG. 11 shows of a high-temperature apparatus member having a diffusion barrier alloy film according to yet another embodiment of the present invention. According to this embodiment, a surface of a metal base 10 of an Ni-base alloy or the like, which has surface irregularities provided in advance, is coated by PVD with a diffusion barrier layer (Re—W(M) alloy layer) 18 serving as a diffusion barrier alloy film to a thickness in the range from 0.5 to 30 μm. After surface irregularities are given to the surface of the diffusion barrier layer 18, the surface of the diffusion barrier layer 18 is coated by spraying or the like with a corrosion-resistant alloy layer 34 of a CoNiCrAlY alloy, for example, to a thickness in the range from 30 to 400 μm.

Figure 12:
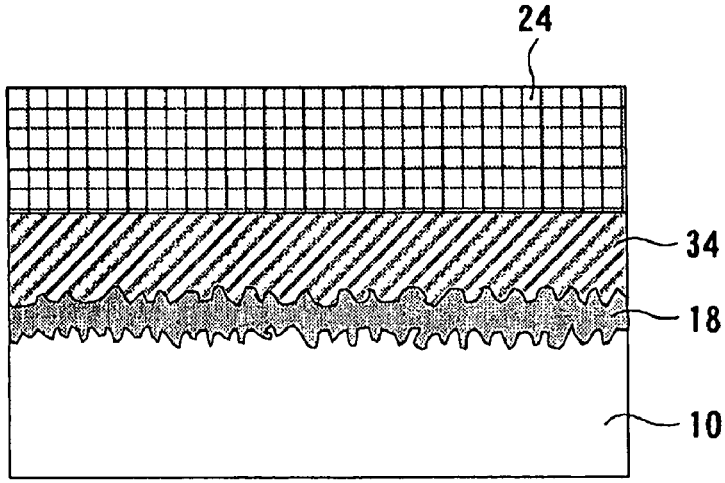
FIG. 12 is a view schematically showing a cross section of the high-temperature apparatus member shown in FIG. 11 with a ceramics layer formed on the surface thereof.

In this embodiment, if required, as shown in FIG. 12, a $ZrO_2$ ceramics coating (so-called heat shield coating), for example, may be applied to a surface of the corrosion-resistant alloy layer 34 to form a ceramics layer 24 having a thickness in the range from 100 to 400 μm, for example.

Figure 13:
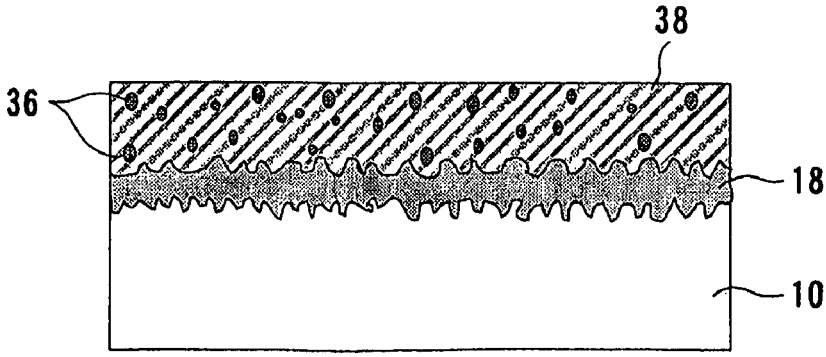
FIG. 13 is a view schematically showing a cross section of a high-temperature apparatus member having a diffusion barrier alloy film according to yet another embodiment of the present invention.

FIG. 13 shows a high-temperature apparatus member having a diffusion barrier alloy film according to yet another embodiment of the present invention. According to this embodiment, a surface of a metal base 10 of an Ni-base alloy or the like, which has surface irregularities provided in advance, is coated by spraying, for example, with a diffusion barrier layer (Re—W(M) alloy layer) 18 serving as a diffusion barrier alloy film to a thickness in the range from 10 to 50 μm. After surface irregularities are given to the surface of the diffusion barrier layer 18, the surface of the diffusion barrier layer 18 is coated by spraying or the like with a wear-resistant layer 38 of a CoNiCrAlY alloy, wherein a W carbide or a Cr carbide 36, for example, is dispersed, to a thickness in the range from 30 to 400 μm.

In the embodiments shown in FIGS. 11 through 13, the recesses of the surface irregularities on the surfaces of the metal base 10 and the diffusion barrier layer 18 have a depth in the range from 1 to 20 μm, for example, and are formed by alumina shot blasting.

Specific examples of high-temperature apparatus members to which the present invention is applied, and examples of the formation of the diffusion barrier alloy films suitable for use in high-temperature apparatus members will be described below.

Figure 14:
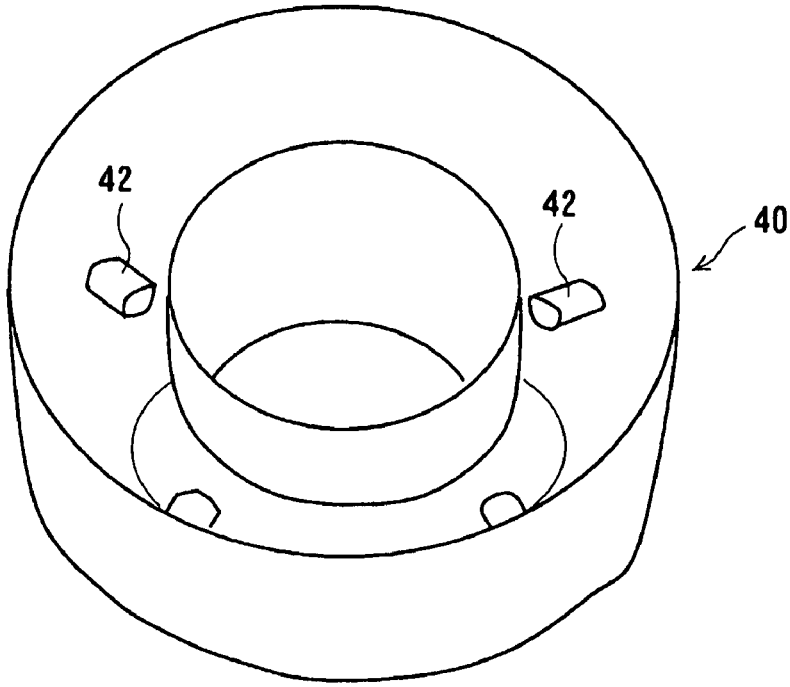
FIG. 14 is a perspective view of a micro gas turbine combustor liner to which the present invention is applied.
Figure 15:
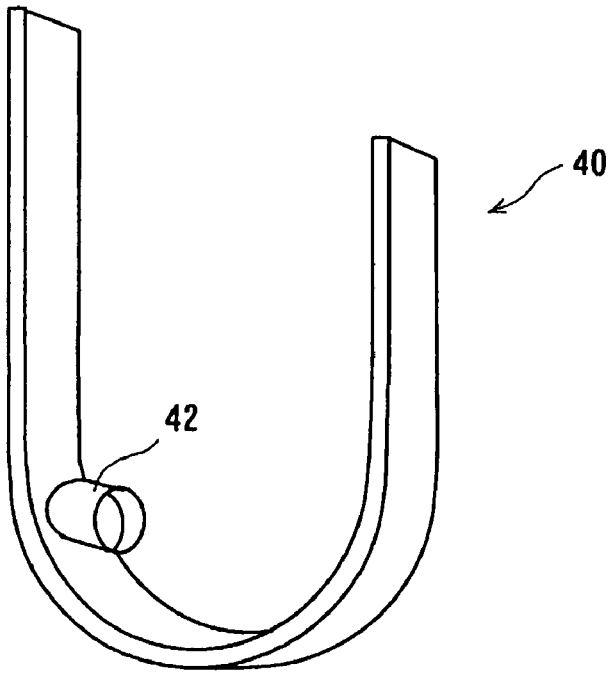
FIG. 15 is a partial cross-sectional view of the micro gas turbine combustor liner shown in FIG. 14.
Figure 16:
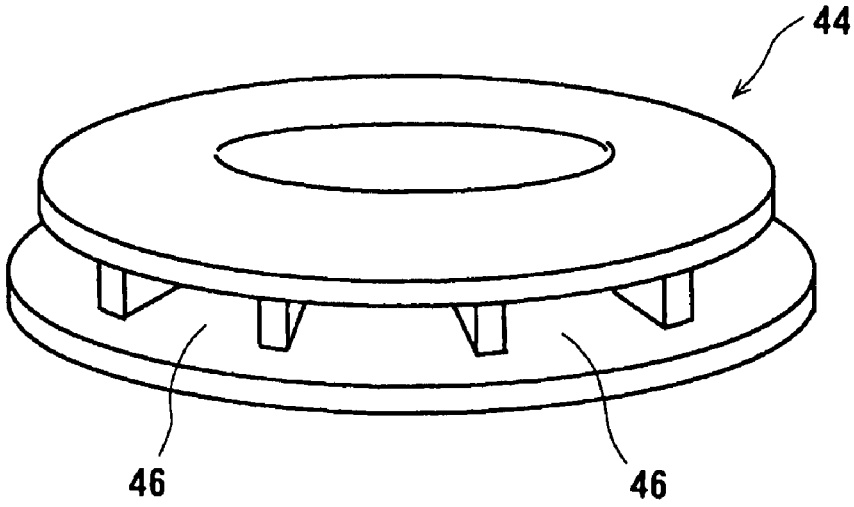
FIG. 16 is a perspective view of a micro gas turbine nozzle to which the present invention is applied.

(1) Micro Gas Turbine Combustor Liner, Turbine Nozzle, Exhaust Manifold, Etc.:

A micro gas turbine combustor liner, to which the present invention is applied, is shown in perspective in FIG. 14, and in partial cross section in FIG. 15. A micro gas turbine nozzle, to which the present invention is applied, is shown in perspective in FIG. 16. An automotive exhaust manifold is shown in perspective in FIG. 17. The micro gas turbine combustor liner 40, shown in FIGS. 14 and 15, has fuel injection nozzles 42 disposed at equal angular intervals in the circumferential direction. The micro gas turbine nozzle 44, shown in FIG. 16, has combustion gas inlet nozzles 46 disposed at equal angular intervals in the circumferential direction. The exhaust manifold 48, shown in FIG. 17, comprises a tube 50 having a complex shape. Each of these members, e.g., the fuel injection nozzles 42 of the micro gas turbine combustor liner 40, has a small hollow shape (small hole) which is required to have a diffusion barrier alloy film formed uniformly therein.

In this example, therefore, a film such as the diffusion barrier film (Re—W(M) alloy layer) 18 as shown in FIG. 6 or the like is formed to a uniform film thickness in the small holes such as the fuel injection nozzles 42 of the micro gas turbine combustor liner 40.

Figure 18:
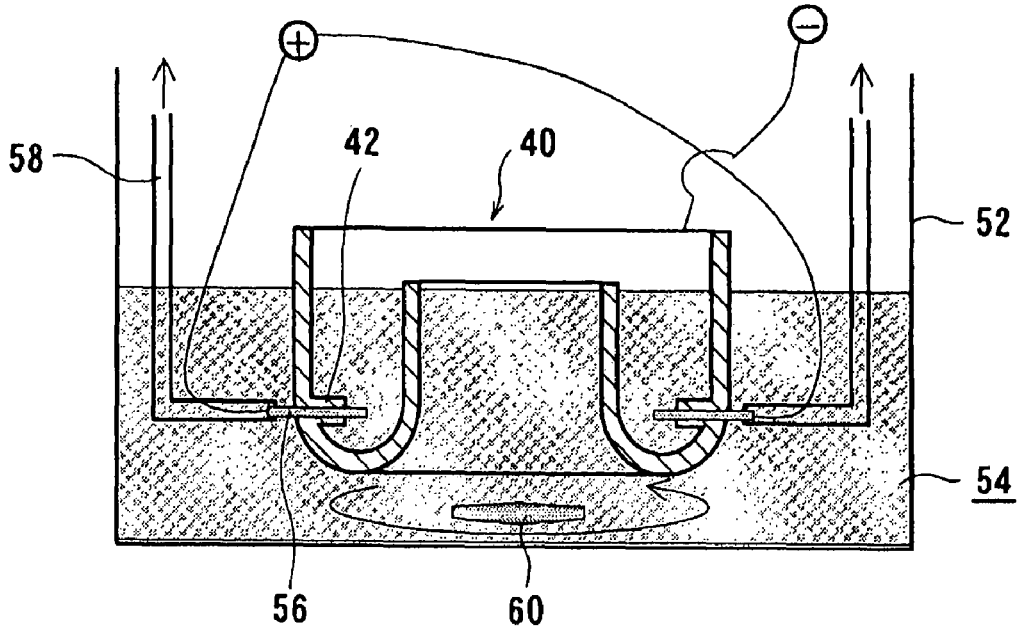
FIG. 18 is a view showing an example of aqueous solution plating performed on fuel injection nozzles of the micro gas turbine combustor liner shown in FIG. 15.

Specifically, with the micro gas turbine combustor liner 40, as shown in FIG. 18, anodes 56 are positioned in the fuel injection nozzles 42 of the micro gas turbine combustor liner 40 which is immersed in a plating solution 54 in a plating bath 52. While the plating solution 54 is being injected from plating solution supply pipes 58 toward the fuel injection nozzles 42, a stirring impeller 60 disposed on the bottom of the plating bath 52 is rotated to stir the plating solution 54 in the plating bath 52. At the same time, a plating voltage is applied between the anodes 56 and the micro gas turbine combustor liner 40 serving as a cathode, thereby plating a film in (on the surface of) the fuel injection nozzles 42 of the micro gas turbine combustor liner 40.

Figure 19:
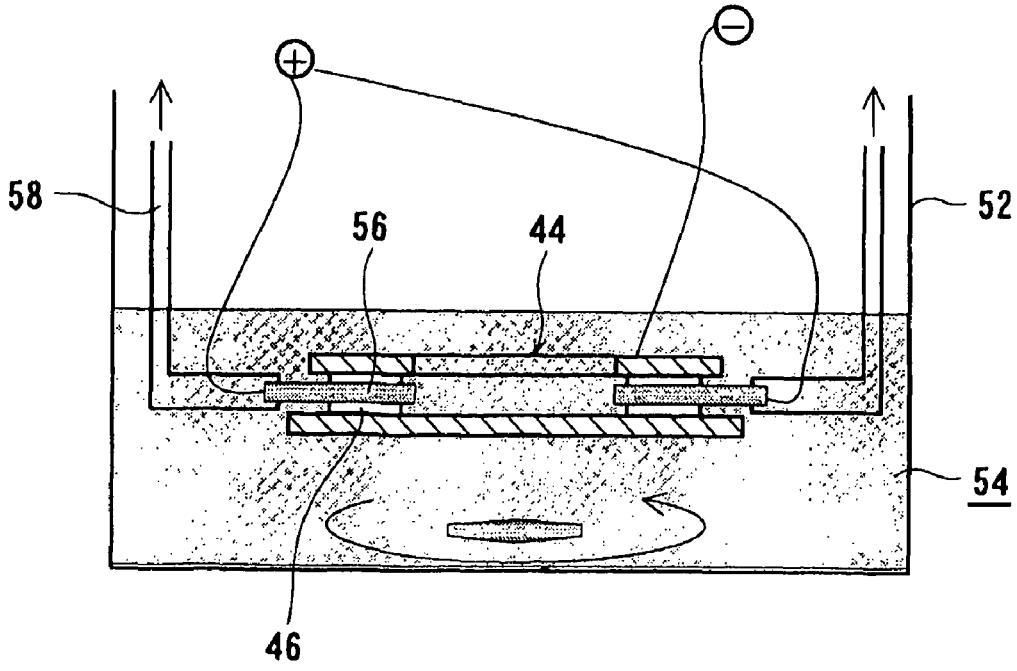
FIG. 19 is a view showing an example of aqueous solution plating performed on combustion gas inlet ports of the micro gas turbine nozzle shown in FIG. 16.

With the micro gas turbine nozzle 44, as shown in FIG. 19, anodes 56 are positioned in the combustion gas inlet ports 46 of the micro gas turbine nozzle 44. As with the preceding example, the plating solution 54 is being injected from plating solution supply pipes 58 toward the combustion gas inlet ports 46, a film is plated in (on the surface of) the combustion gas inlet ports 46 of the micro gas turbine nozzle 44.

Although not shown, for forming a film such as the diffusion barrier layer (Re—W(M) alloy layer) 18 as shown in FIG. 6 or the like on the surface of small holes of a member with such small holes, anodes may be inserted into the small holes according to the shape of the member, and the surface of the small holes may be plated while a plating solution is being injected into the small holes. In this manner, a film may be formed to a uniform film thickness in the small holes.

In this example, the micro gas turbine combustor liner 40 and the micro gas turbine nozzle 44 are made of Ni-base alloy Hastelloy X (Ni-22% Cr-19% Fe-9% Mo-0.1% C). However, a uniform film can be grown in small holes in other high-temperature members by the same process.

More specifically, the member such as the micro gas turbine combustor liner 40 or the like is immersed in a sodium hydrogensulfate/sodium fluoride solution for 30 to 120 seconds to activate the surface thereof. Then, Ni strike plating is performed at a normal temperature at a current density ranging from 100 to 500 mA/cm$^2$ for 0.5 to 5 minutes. Thereafter, Re—Ni plating is performed. The Re—Ni plating is performed using a plating bath containing 0.02 to 0.2 mol/L of $ReO_4^-$, 0.02 to 0.2 mol/L of $NiSO_4$, 0.1 to 0.5 mol/L of $CrCl_3$, 0.1 to 0.5 mol/L of citric acid, and 0.5 to 1.5 mol/L of serine, with pH being adjusted to 2 to 4 with sulfuric acid. Appropriate plating conditions include 40 to 60° C., 10 to 150 mA/cm % and 10 to 60 minutes.

Thereafter, the Ni strike plating is performed again under the above conditions, and Ni—W plating is performed. The Ni—W plating is performed using a plating bath containing 0.05 to 0.2 mol/L of $NiSO_4$, 0.1 to 0.4 mol/L of $NaWO_4$, and 0.1 to 0.8 mol/L of citric acid, with pH being adjusted to 6 to 9 with ammonia water. Appropriate plating conditions include 50 to 80° C., 20 to 150 mA/cm % and 10 to 60 minutes.

After the Ni—W plating, Ni strike plating is performed again under the above conditions, and then Ni plating is performed in an Ni Watts bath under plating conditions which may include 40 to 60° C., 5 to 50 mA/cm % and 5 to 120 minutes.

After the above sequence of plating processes, the member is heat-treated in a vacuum of $10^{-3}$ Pa at 1200-1350° C. for 1 to 20 hours. According to this example, since the member is made of Hastelloy X containing about 20% of Cr, the member is simply heat-treated in the vacuum. If the concentration of Cr in the metal base is less than 20%, then the member may be embedded and heat-treated in a mixed powder of Ni—Cr alloy or Cr and $Al_2O_3$ ($Al_2O_3$ having a volume ratio of 1 or greater). When the member is plated and heat-treated under the above conditions, the diffusion barrier layer (Re—W(M) alloy film) 18 shown in FIG. 6 can uniformly be formed to a thickness ranging from 0.5 to 30 μm in (on the surface of) the small holes such as the fuel injection nozzles 42 of the micro gas turbine combustor liner 40 or the like, for example. Though the diffusion barrier layer 18 may contain a few % of X (=Cr, Ni, Fe, Mo) diffused primarily from the metal base, the diffusion barrier layer 18 is essentially made of an Re—W (M) alloy containing 30 atomic % or more of Re and 20 atomic % or more of W.

After the diffusion barrier layer 18 has been formed on the member, as described above, the member is treated by Ni strike plating and Ni plating in an Ni Watts bath with 0.01 to 5 weight % of $Zr^{4+}$ dissolved therein, whereby an Ni plated layer containing 0.01 to 0.5 atomic % of Zr is formed on the member. Thereafter, an Al diffusion process is performed. Rather than the Ni plating in the Ni Watts bath with $Zr^{4+}$ dissolved therein, composite plating may be performed in an Ni Watts bath with a dispersion of 0.1 to 1.0% of a Zr powder having a particle diameter ranging from 0.5 to 50 μm or an NiZr alloy powder, a $ZrSi_2$ powder, a Y powder, or the like. Specifically, after the plating process, the member is heat-treated in three stages, i.e., heat-treated at 800 to 900° C. for 1 to 20 hours, heat-treated at 900 to 1000° C. for 1 to 10 hours, and heat-treated at 1000 to 1200° C. for 1 to 10 hours, forming an Ni(X) layer (X=Zr, Si, Y) thereon. Thereafter, the Al dispersion process is performed.

The Al dispersion process is performed in a mixed powder of Al, $Al_2O_3$, and $NH_4Cl$ in a vacuum of $10^{-3}$ Pa at 800 to 1100° C. for 10 minutes to 5 hours. The mixed powder of Al, $Al_2O_3$, and $NH_4Cl$ has such a composition that the weight ratio of $Al_2O_3$/Al is 1 or more with $NH_4Cl$ ranging from 0.1 to 10% of the overall mixture. The Al dispersion process may be performed in an inactive atmosphere (e.g., of Ar) rather than the vacuum. The Al dispersion process may be replaced with a hot dip Al plating process. According to the hot dip Al plating process, the member is immersed in a hot dip Al plating bath at a temperature ranging from 700 to 900° C. for 10 minutes to 5 hours.

By treating the member as described above, it is possible to form a coating layer comprising the diffusion barrier layer (Re—W(M) alloy layer) 18 and the diffusion alloy layer 20 in the form of an Ni—Al(X) alloy layer (X=Zr, Y, Si), uniformly on the surfaces of small holes such as the fuel injection nozzles 42 of the micro gas turbine combustor liner 40 or the like, for example. The combustor liner and the turbine nozzle with the coating layer applied thereto will not be fatally oxidized and corroded for 1000 hours or more and remain in sound conditions even when the surface temperature of the coating layer reaches 1100 to 1200° C.

Figure 20:
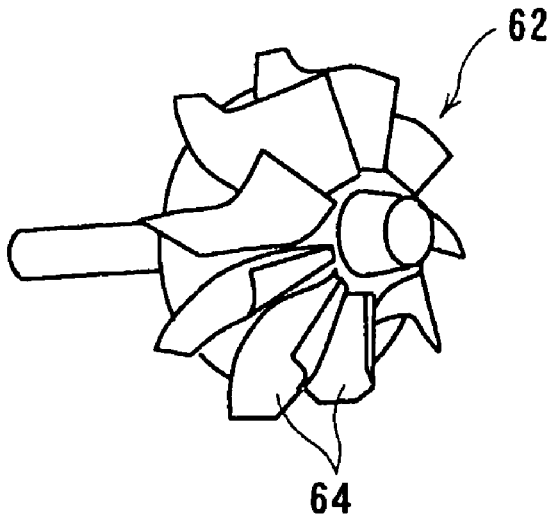
FIG. 20 is a perspective view of a micro gas turbine rotor impeller to which the present invention is applied.

(2) Micro Gas Turbine Rotor Impeller, Automotive Turbocharger, Etc.:

A micro gas turbine rotor impeller, to which the present invention is applied, is shown in perspective view in FIG. 20. As shown in FIG. 20, the micro gas turbine rotor impeller 62 comprises a radial rotor impeller having a plurality of blades 64 having a shape with a large curvature. In this example, while the micro gas turbine rotor impeller 62 is rotating, a film such as the diffusion barrier layer (Re—W(M) alloy layer) 18 or the like shown in FIGS. 8A and 8B is formed to a uniform film thickness on surfaces of the micro gas turbine rotor impeller 62 mainly including the surfaces of the blades 64, by aqueous solution plating.

Figure 21:
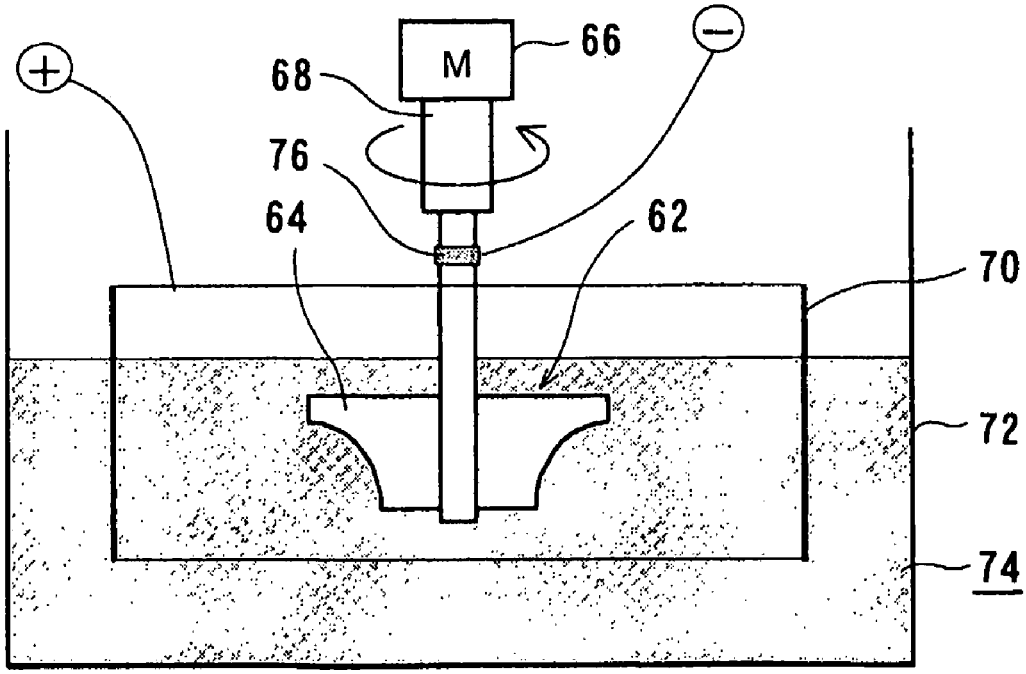
FIG. 21 is a view showing an example of aqueous solution plating performed on the micro gas turbine rotor impeller shown in FIG. 20.

Specifically, as shown in FIG. 21, the micro gas turbine rotor impeller 62 is coupled to the lower end of a rotational shaft 68 which is rotatable when a motor 66 is energized, and is immersed in a plating solution 74 surrounded in a hollow cylindrical anode 70 in a plating bath 72. When the micro gas turbine rotor impeller 62 is rotated by the motor 66, a plating voltage is applied between the anode 70 and the micro gas turbine rotor impeller 62 serves as a cathode via a sliding contact 76, thereby plating the surfaces of the micro gas turbine rotor impeller 62.

Though not shown, for forming a film such as the diffusion barrier layer (Re—W(M) alloy layer) 18 or the like shown in FIGS. 8A and 8B on the surfaces of an automotive turbocharger, the member is rotated and plated to form a film having a uniform film thickness on the surfaces of the member.

In this example, the micro gas turbine rotor impeller 62 is made of an Ni-base alloy Mar-M247 (Ni-8% Cr-10% Co-5% Al-10% W—Ta-Ti). A uniform film can also be grown on the blade surfaces of high-temperature members of similar shapes, e.g., an automotive turbocharger or the like, according to a similar process.

More specifically, the member such as the micro gas turbine rotor impeller 62 or the like is immersed in a sodium hydrogensulfate/sodium fluoride solution for 30 to 120 seconds to activate the surface thereof. Then, Cr plating is performed. The Cr plating is performed using a Cr(III) bath (containing, for example, 0.1 to 0.5 mol/L of $CrCl_3$, 0.1 to 1.5 mol/L of HCOOH, 0.1 to 1.5 mol/L of $H_3BO_3$, 0.1 to 1.5 mol/L of $NH_4Cl$, and 0.1 to 1.5 mol/L of KBr, with pH being adjusted to 2 to 4 with sulfuric acid) at normal temperature to 30° C. at 50 to 150 mA/cm$^2$ for 15 to 60 minutes. The Cr(III) bath may be replaced with a Cr(VI) bath (Sargent bath). If the Cr(VI) bath is used, care should be taken because the subsequent adhesion of the plated layer is slightly lowered.

Thereafter, after the member is activated again in a sodium hydrogensulfate/sodium fluoride solution, Ni strike plating is performed at normal temperature at a current density ranging from 100 to 500 mA/cm$^2$ for 0.5 to 5 minutes. After the Ni strike plating, Re—Ni plating is performed at 40 to 60° C. at 10 to 150 mA/cm$^2$ for 10 to 60 minutes. The Re—Ni alloy plating bath may be the same as the bath used in the above embodiment. Thereafter, Ni strike plating is performed under the above conditions, followed by Ni—W plating. Appropriate Ni—W plating conditions include 50 to 80° C., 20 to 150 mA/cm % and 10 to 60 minutes. The Ni—W plating bath may also be the same as the bath used in the above embodiment.

After the Ni—W plating, Ni strike plating is performed again under the above conditions, and then Ni plating is performed in an Ni Watts bath under plating conditions which may include 40 to 60° C., 5 to 50 mA/cm % and 5 to 120 minutes. The Ni plating may be performed using an Ni Watts bath with 0.01 to 5 weight % of $Zr^{4+}$ dissolved therein. In this case, Zr ($ZrOCl_2$, $ZrCl_4$, Y, $YCl_3$, or the like) may not be mixed in an Al diffusion process to be described later.

After the above sequence of plating processes, the member is heat-treated in a vacuum of $10^{-3}$ Pa at 1200-1350° C. for 1 to 20 hours. At this time, the member may be embedded and heat-treated in a mixed powder of Ni—Cr alloy or Cr and $Al_2O_3$ ($Al_2O_3$ having a volume ratio of 1 or greater).

When the member is plated and heat-treated under the above conditions, a coating layer comprising the diffusion barrier layer 18 and the Ni(Cr) alloy layer 26 shown in FIG. 8A can be formed on the surfaces of the micro gas turbine rotor impeller 62 or the like.

Thereafter, the Al dispersion process is performed in a mixed powder of Al, $Al_2O_3$, $NH_4Cl$, and Zr in a vacuum of $10^{-3}$ Pa at 800 to 1100° C. for 10 minutes to 5 hours. The mixed powder of Al, $Al_2O_3$, $NH_4Cl$, Zr has such a composition that the weight ratio of $Al_2O_3$/Al is 1 or more with each of $NH_4Cl$ and Zr ranging from 0.1 to 100 of the overall mixture. The Al dispersion process may be performed in an inactive atmosphere (e.g., of Ar) rather than the vacuum. Zr may be replaced with $ZrOCl_2$, $ZrCl_4$, Y, $YCl_3$, or the like.

By treating the member as described above, it is possible to form a coating layer comprising the diffusion barrier layer (Re—W(M) alloy layer) 18 and the diffusion alloy layer 28 in the form of an Ni(Cr)—Al(X) alloy layer shown in FIG. 8B, uniformly on the blade surfaces of the micro gas turbine rotor impeller 62 or the like. The micro gas turbine rotor impeller and the automotive turbocharger with the coating layer applied thereto will not be fatally oxidized and corroded for 1000 hours or more, and remain in sound condition even when the surface temperature of the coating layer reaches 1100 to 1200° C.

Figure 17:
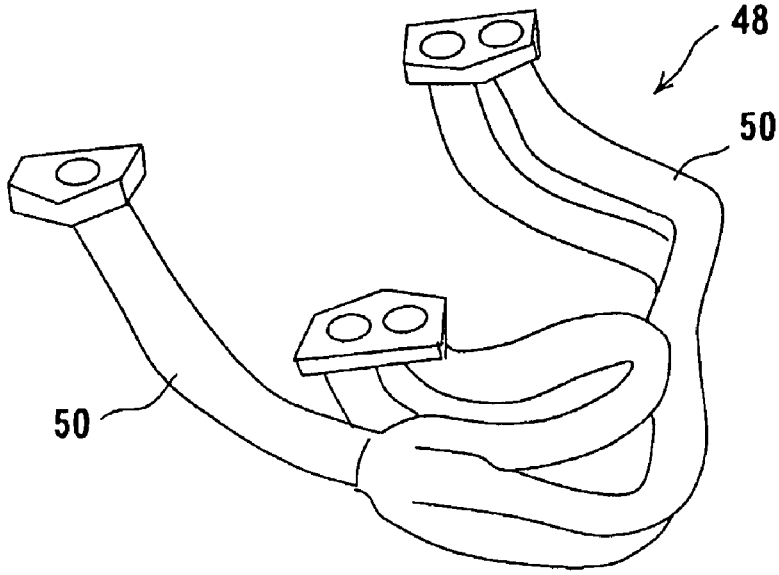
FIG. 17 is a perspective view of an automotive exhaust manifold to which the present invention is applied.
Figure 22A:
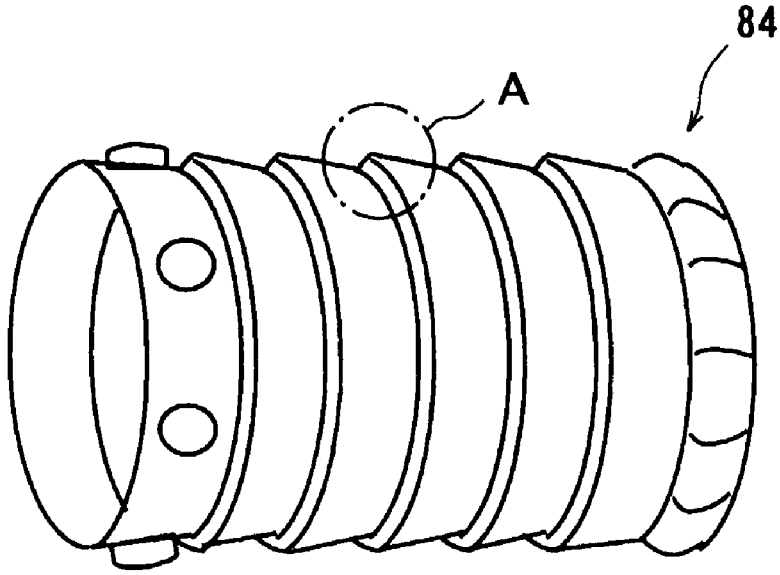
FIG. 22A is a perspective view of a gas turbine combustor to which the present invention is applied.
Figure 22B:
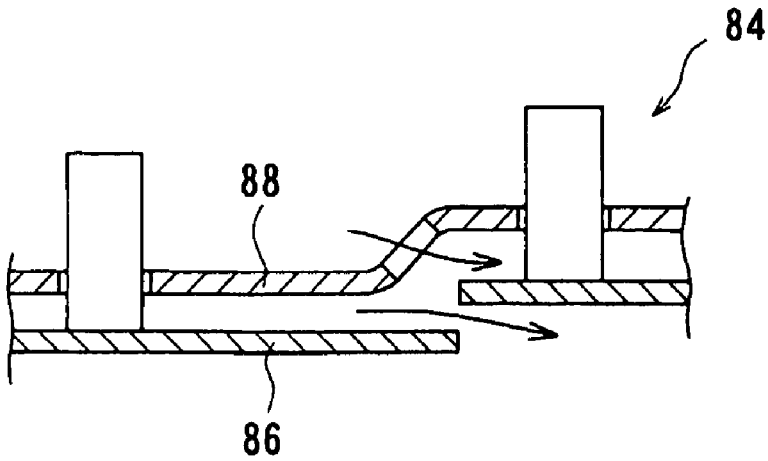
FIG. 22B is an enlarged cross-sectional view of an area A shown in FIG. 22A.
Figure 23:
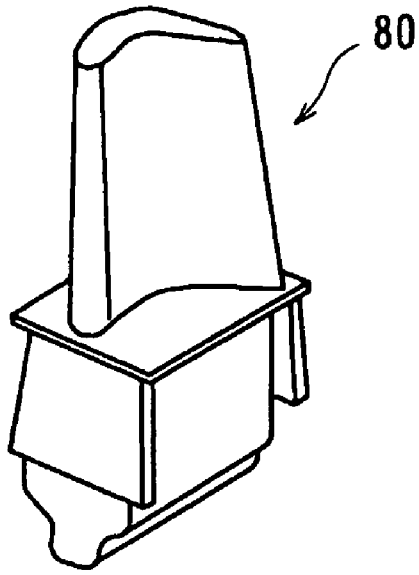
FIG. 23 is a perspective view of a gas turbine rotor blade to which the present invention is applied.
Figure 24:
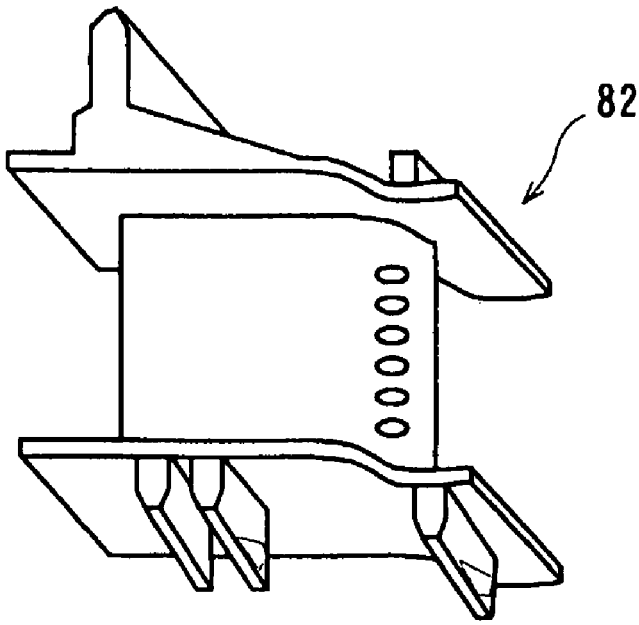
FIG. 24 is a perspective view of a gas turbine stator vane to which the present invention is applied.
Figure 25:
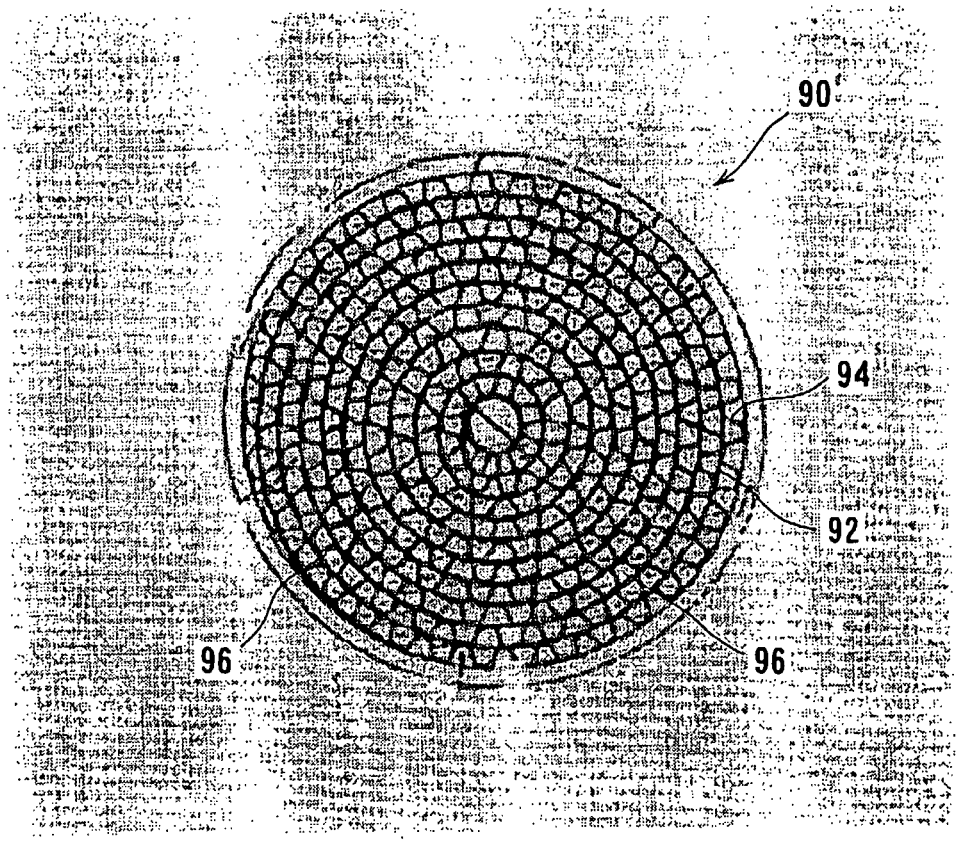
FIG. 25 is a cross-sectional view of an automotive catalytic converter to which the present invention is applied.
Figure 26:
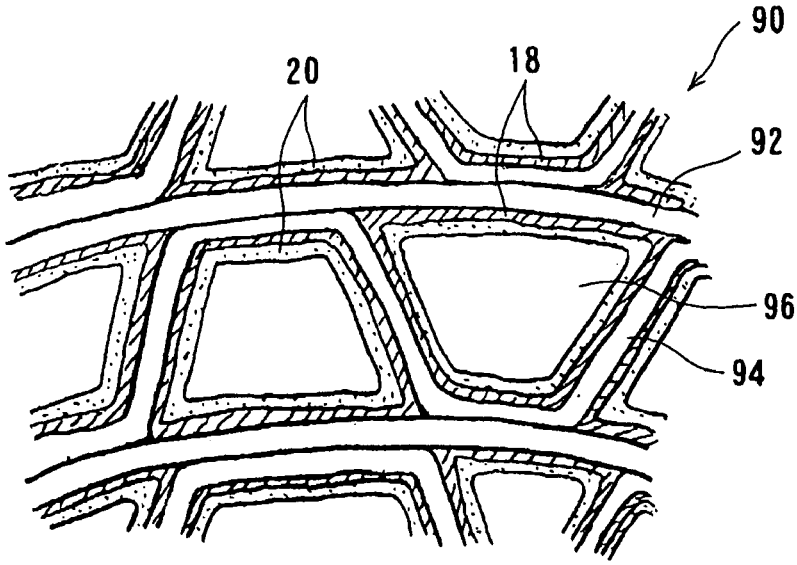
FIG. 26 is an enlarged fragmentary view of the automotive catalytic converter shown in FIG. 25 with a diffusion barrier alloy film formed thereon.

(3) Gas Turbine Member, Jet Engine Member, Automotive Exhaust Manifold, Catalytic Converter, Etc.:

A gas turbine combustor, to which the present invention is applied, is shown in FIGS. 22A and 22B. A gas turbine rotor blade, to which the present invention is applied, is shown in FIG. 23. A gas turbine stator vane, to which the present invention is applied, is shown in FIG. 24. An automotive catalytic converter, to which the present invention is applied, is shown in cross section in FIGS. 25 and 26. An automotive exhaust manifold is shown in perspective in FIG. 17. The gas turbine rotor blade 80 shown in FIG. 23 and the gas turbine stator vane 82 shown in FIG. 24 are expected to undergo high stresses while they are in operation or when they start and stop operating. The automotive exhaust manifold 48 shown in FIG. 17 is liable to suffer fatigue breakdown due to vibrations during operation. The gas turbine combustor 84 shown in FIGS. 22A and 22B is of a double-walled construction having an inner tube 86 and an outer tube 88 for passing cooling air therethrough. Uniform film growth is required on each of the outer and inner circumferential surfaces of the inner tube 86 and the outer tube 88 which are superposed over each other. The automotive catalytic converter 90 shown in FIGS. 25 and 26 is generally of a considerably complex configuration having a number of honeycomb-shaped vent holes 96 defined by flat foils 92 and corrugated foils 94, for example. For forming the coating layer comprising the diffusion barrier layer 18 and the diffusion ally layer 20 shown in FIG. 6 in particular on the surface of the metal base 10 of each of these members, it is therefore necessary to reduce the thickness of and uniformly form the diffusion barrier layer 18 which has a different coefficient of thermal expansion from the metal base 10 and the diffusion alloy layer 20, for preventing the coating layer from suffering breakdown.

The example is applied to the gas turbine rotor blade 80 which is made of an Ni-base superalloy (Ni-6% Cr-5% Al-6% W-9% Co-6% Ta-3% Re). The example is also applicable to a gas turbine combustor liner, a gas turbine stator vane, a jet engine member, an exhaust manifold, or a catalytic converter.

In this example, the member such as the gas turbine rotor blade 80 is immersed in a sodium hydrogensulfate/sodium fluoride solution for 30 to 120 seconds to activate the surface thereof. Then, Ni strike plating is performed at a normal temperature at a current density ranging from 100 to 500 mA/cm$^2$ for 0.5 to 5 minutes. Thereafter, Ni—W plating is performed. The Ni—W plating is performed using the same Ni—W alloy plating bath as with the above embodiment. Appropriate plating conditions include 50 to 80° C., 20 to 100 mA/cm % and 15 to 30 minutes. After the Ni—W plating, Ni strike plating is performed under the above conditions, and then Re—Ni plating is performed using the same Re—Ni alloy plating bath as with the above embodiment. Appropriate plating conditions include 40 to 60° C., 20 to 120 mA/cm % and 20 to 45 minutes.

Thereafter, Ni strike plating is performed again under the above conditions, followed by Ni plating using an Ni Watts bath under plating conditions which may include 40 to 60° C., 5 to 50 mA/cm % and 5 to 120 minutes.

After the above sequence of plating processes, the member such as the gas turbine rotor blade 80 or the like is embedded and heat-treated in a mixed powder of Ni—(20-50)% Cr alloy or Cr and $Al_2O_3$ ($Al_2O_3$ having a volume ratio of 1 or greater) in a vacuum of $10^{-3}$ Pa at 1200-1350° C. for 3 to 20 hours. When the member is plated and heat-treated under the above conditions, the diffusion barrier layer (Re—W(M) alloy layer) 18 shown in FIG. 6 can be formed to a thickness ranging from 1 to 15 μm on the surfaces of the member such as the gas turbine rotor blade 80 or the like.

After the diffusion barrier layer 18 has been formed on the member such as the gas turbine rotor blade 80 or the like, the member is treated by Ni plating in an Ni Watts bath at 40 to 60° C. at 5 to 50 mA/cm$^2$ for 5 to 120 minutes. The Ni plating may be performed using an Ni Watts bath with 0.01 to 5 weight % of $Zr^{4+}$ dissolved therein. In this case, Zr ($ZrOCl_2$, $ZrCl_4$, Y, $YCl_3$, or the like) may not be mixed in an Al diffusion process to be described later.

Thereafter, the Al dispersion process is performed in a mixed powder of Al, $Al_2O_3$, $NH_4Cl$, and Zr in a vacuum of $10^{-3}$ Pa at 800 to 1100° C. for 10 minutes to 5 hours. The mixed powder of Al, $Al_2O_3$, $NH_4Cl$, Zr has such a composition that the weight ratio of $Al_2O_3$/Al is 1 or more with each of $NH_4Cl$ and Zr ranging from 0.1 to 50 of the overall mixture. The Al dispersion process may be performed in an inactive atmosphere (e.g., of Ar) rather than the vacuum. Zr may be replaced with $ZrOCl_2$, $ZrCl_4$, Y, $YCl_3$, or the like.

By treating the member as described above, it is possible to form a coating layer comprising the diffusion barrier layer (Re—W(M) alloy layer) 18 and the diffusion alloy layer 20 in the form of an Ni—Al(X) alloy layer (X=Zr, Y, Si) shown in FIG. 6, uniformly to a thickness ranging from 1 to 15 μm on the surfaces of the member. Furthermore, if required, as shown in FIG. 7, a $ZrO_2$ ceramics coating (so-called heat shield coating) may be applied to the surface of the coating layer to form a ceramics layer 24 having a thickness in the range from 100 to 400 μm. This makes it possible to produce gas turbines or jet engines which are capable of combustion at higher temperatures than heretofore and which have high thermal efficiency.

If the example is applied to the automotive catalytic converter 90 shown in FIG. 25, then a $ZrO_2$ ceramics coating (so-called heat shield coating) is not applied. However, as shown in FIG. 26, a coating layer comprising the diffusion barrier layer (Re—W(M) alloy layer) 18 and the diffusion alloy layer 20 is formed on the surfaces of the flat foils 92 and the corrugated foils 94 which define the honeycomb-shaped vent holes 96.

The gas turbine member and the jet engine member with the coating layer applied thereto will not be fatally oxidized and corroded for 1000 hours or more and remain in sound conditions even when the surface temperature of the coating layer reaches 1100 to 1200° C.

(4) Gas Turbine Member, Jet Engine Member, Automotive Exhaust Manifold, Etc.:

As described above, the gas turbine rotor blade 80 shown in FIG. 23 and the gas turbine stator vane 82 shown in FIG. 24 are expected to undergo high stresses while they are in operation or when they start and stop operating. The automotive exhaust manifold 48 shown in FIG. 17 is liable to suffer fatigue breakdown due to vibrations during operation. The gas turbine combustor 84 shown in FIGS. 22A and 22B is of a double-walled construction having an inner tube 86 and an outer tube 88 for passing cooling air therethrough, and uniform film growth is required on each of the outer and inner circumferential surfaces of the inner tube 86 and the outer tube 88 which are superposed over each other. With these members, therefore, for forming the coating layer comprising the diffusion barrier layer 18 and the diffusion ally layer 20 shown in FIG. 9 in particular on the surface of the metal base 10 of each of these members, it is necessary to increase the adhesion of the diffusion barrier layer 18, which has a different coefficient of thermal expansion from the metal base 10 and the diffusion alloy layer 20, to the metal base 10 and the diffusion alloy layer 20. The example is applied to the gas turbine rotor blade 80 which is made of an Ni-base superalloy (Ni-6% Cr-5% Al-6% W-9% Co-6% Ta-3% Re). The example is also applicable to a gas turbine combustor liner, a gas turbine stator vane, a jet engine member, or an automotive exhaust manifold.

In this example, the member such as the gas turbine rotor blade 80 or the like is immersed in a sodium hydrogensulfate/sodium fluoride solution for 30 to 120 seconds to activate the surface thereof. Then, Ni strike plating is performed at normal temperature at a current density ranging from 100 to 500 mA/cm$^2$ for 0.5 to 5 minutes. Thereafter, Re—Ni plating is performed. The Re—Ni plating is performed using two plating baths to be described later. First, the Re—Ni plating is performed using an ammoniacal citric acid bath (containing, for example, 0.02 to 1.0 mol/L of $ReO_4$, 0.02 to 1.0 mol/L of $NiSO_4$, and 0.04 to 2.0 mol/L of citric acid, with pH being adjusted to 6 to 8 with ammonia water) at 40 to 60° C. at 20 to 150 mA/cm$^2$ for 20 to 40 minutes. The plating process forms an Re—Ni alloy film containing 25 to 40 atomic % of Re. Secondly, the Re—Ni plating is performed using another Re—Ni bath (containing, for example, 0.02 to 0.2 mol/L of $ReO_4$, 0.02 to 0.2 mol/L of $NiSO_4$, 0.1 to 0.5 mol/L of $CrCl_3$, 0.1 to 0.5 mol/L of citric acid, and 0.5 to 1.5 mol/L of serine, with pH being adjusted to 2 to 4 with sulfuric acid) at 40 to 60° C. at 20 to 150 mA/cm$^2$ for 20 to 40 minutes. The plating process forms an Re—Ni alloy film containing 65 to 90 atomic % of Re.

After the two-stage Re—Ni plating process, Ni strike plating is performed under the above conditions. Thereafter, Ni—W plating is performed at 50 to 80° C. at 20 to 150 mA/cm$^2$ for 10 to 60 minutes. The Ni—W plating may be performed using the same Ni—W plating bath as with the above embodiment. Thereafter, Ni strike plating is performed again under the above conditions for 5 to 20 minutes. Thereafter, Ni—W plating is performed again under the above conditions.

After the above sequence of plating processes, the member such as the gas turbine rotor blade 80 or the like is embedded and heat-treated in a mixed powder of Ni-(20-50)% Cr alloy or Cr and $Al_2O_3$ ($Al_2O_3$ having a volume ratio of 1 or greater) in a vacuum of $10^{-3}$ Pa at 1200-1350° C. for 1 to 20 hours. If the alloy used as the material of the member contains 200 or more of Cr, then the member such as the gas turbine rotor blade 80 or the like may not be embedded in the mixed powder of Ni-(20-50)% Cr alloy or Cr and $Al_2O_3$, but may be simply heat-treated in a vacuum or an inactive atmosphere (e.g., of Ar).

After the member such as the gas turbine rotor blade 80 or the like has been heat-treated, the member is treated again by Ni strike plating and Ni plating in an Ni Watts bath. Thereafter, the member is treated by an Al diffusion process. The Ni plating may be performed using an Ni Watts bath with 0.01 to 5 weight % of $Zr^{4+}$ dissolved therein. In this case, Zr ($ZrOCl_2$, $ZrCl_4$, Y, $YCl_3$, or the like) may not be mixed with a pack powder in an Al diffusion process to be described later.

The Al dispersion process is performed in a mixed powder of Al, $Al_2O_3$, $NH_4Cl$, and Zr in a vacuum of $10^{-3}$ Pa at 800 to 1100° C. for 10 minutes to 5 hours. The mixed powder of Al, $Al_2O_3$, $NH_4Cl$, Zr has such a composition that the weight ratio of $Al_2O_3$/Al is 1 or more with each of $NH_4Cl$ and Zr ranging from 0.1 to 5% of the overall mixture. The Al dispersion process may be performed in an inactive atmosphere (e.g., of Ar) rather than the vacuum. Zr may be replaced with $ZrOCl_2$, $ZrCl_4$, Y, $YCl_3$, or the like.

By treating the member as described above, it is possible to form a coating layer shown in FIG. 9 comprising the Re-dispersed layer 30 where Re is dispersed, the diffusion barrier layer (Re—W(M) alloy layer) 18, the W-dispersed layer 32 where W is dispersed, and the diffusion alloy layer 20 in the form of an Ni—Al(X) alloy layer (X=Zr, Y, Si). The coating layer of the above structure is formed because since Re in the first Re—Ni alloy plating process is of a low concentration (25 to 40 atomic %), Re in the second Re—Ni alloy plating process is of a high concentration (65 to 90 atomic %), and W in the Ni-W alloy plating process is of a low concentration (about 25 atomic %), the low-concentration Re—Ni layer adjacent to the metal base (Ni-base alloy base) 10 is separated into two phases, i.e., Ni phase with a solid solution of Re and an Re phase with a solid solution of Ni, and the Ni—W layer adjacent to the diffusion alloy layer 20 is separated into an Ni phase with a solid solution of W and a W phase with a solid solution of Ni.

As a result, a so-called "wedge structure" wherein the Re-dispersed layer 30 is disposed in the interface between the metal base 10 and the diffusion barrier layer 18 and the W-dispersed layer 32 is disposed in the interface between the diffusion barrier layer 18 and the diffusion alloy layer 20, giving an "anchor effect" to the Re-dispersed layer 30 and the W-dispersed layer 32, the bonding forces between the metal base 10 and the diffusion barrier layer 18 and between the diffusion barrier layer 18 and the diffusion alloy layer 20 are increased. Furthermore, the Re-dispersed layer 30, wherein R particles having diameters in the range from 1 to 20 μm are dispersed at a volume ratio in the range from 10 to 80, is inserted to a thickness ranging from 1 to 100 μm between the metal base 10 and the diffusion barrier layer 18, and the W-dispersed layer 32, wherein W particles having diameters in the range from 1 to 20 μm are dispersed at a volume ratio in the range from 10 to 80%, is inserted to a thickness ranging from 1 to 100 μm between the diffusion barrier layer 18 and the diffusion alloy layer 20, so that a macro coefficient of linear expansion is of an intermediate value between those of the layers.

In this manner, the diffusion barrier layer 18, which is made of an Re—W alloy having a coefficient of thermal expansion greatly different from those of an Ni base, a Co base, or an Fe base alloy and tending to peel easily off due to thermal stresses developed when the member starts and stops operating, is prevented from being peeled off the turbine member or the like.

Furthermore, a $ZrO_2$ ceramics coating (so-called heat shield coating) may be applied to the surface of above-described coating layer to form a ceramics layer 24, as shown in FIG. 10, having a thickness ranging from 100 to 400 μm. This makes it possible to produce gas turbines or jet engines which are capable of combustion at higher temperatures than heretofore and which have high thermal efficiency. The gas turbine and jet engine members with the coating layer applied thereto will not be fatally oxidized and corroded for 1000 hours or more and remain in sound condition even when the surface temperature of the coating layer reaches 1100 to 1200° C.

Figure 27:
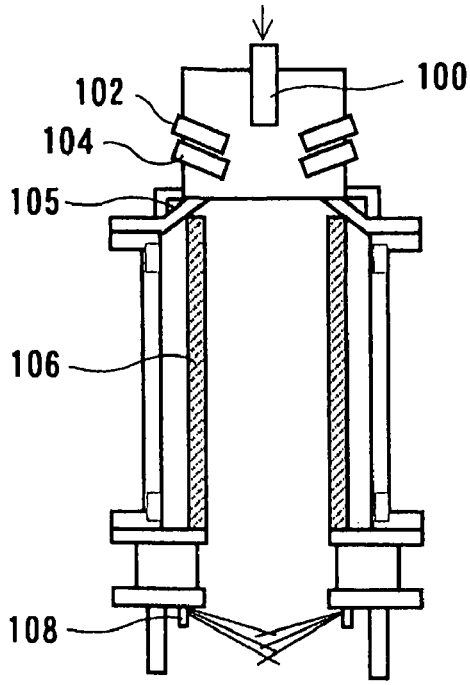
FIG. 27 is a view schematically showing a semiconductor fabrication discharge gas treating apparatus to which the present invention is applied.
Figure 28:
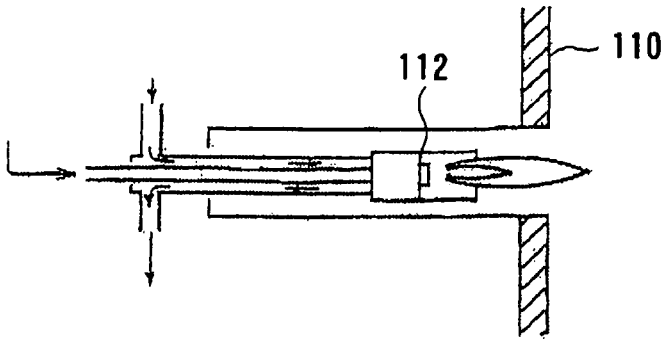
FIG. 28 is a view showing a burner to which the present invention is applied.
Figure 29:
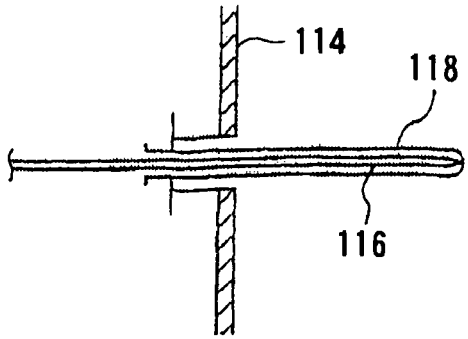
FIG. 29 is a view showing a protective sheath of a thermocouple to which the present invention is applied.

(5) Discharge Gas Treating Apparatus Member, Waste Incinerating Member, Gasifying Apparatus Member, Etc.:

A semiconductor fabrication discharge gas treating apparatus, to which the present invention is applied, is schematically shown in FIG. 27. A burner and a protective sheath of a thermocouple for use in a waste incinerator or a gasifying apparatus are shown respectively in FIGS. 28 and 29. As shown in FIG. 27, the semiconductor fabrication discharge gas treating apparatus, for example, is constructed such that a discharge gas supplied from a discharge gas supply pipe 100 and combusted by burners 104 with air ejected from assistive air nozzles 102 is introduced into and treated by a reaction tower 106 surrounded by a water-cooling jacket 105, and the treated discharge gas is cooled by cooling water ejected from cooling spray nozzles 108 and discharged out of the semiconductor fabrication discharge gas treating apparatus. In particular, a high-temperature halogen gas is handled in the reaction tower 106. Therefore, if a coating layer for protecting the reaction tower 106 from the high-temperature halogen gas is defective, then the semiconductor fabrication discharge gas treating apparatus is likely to be highly corroded. As shown in FIG. 28, a burner 110 of a waste incinerator or a gasifying apparatus is mounted on a furnace wall 110 and exposed to an interior space of the furnace wall 110 for producing flames. As shown in FIG. 29, a protective sheath 118 is disposed in surrounding relation to a thermocouple 116 disposed in a furnace wall 114 for projecting the thermocouple 116. The burner 110 and the protective sheath 118 are exposed to a high-temperature chlorinating corrosive environment. Therefore, these members are required to be protected by a dense defect-free coating layer. It is desirable to form such a dense defect-free coating layer according to a fused-salt plating process.

The example is applied to the reaction tower 106 of the semiconductor fabrication discharge gas treating apparatus, which is made of an Ni-base alloy (Ni-22% Cr-19% Fe-9% Mo-0.1% C). The example is also applicable to a member that is exposed to a high-temperature chlorinating corrosive environment, such as the burner 112 of the waste incinerator or the gasifying apparatus shown in FIG. 28 or the protective sheath of the thermocouple shown in FIG. 29. Furthermore, the example is also applicable to a member which is of a complex shape and cannot be treated by a physical process such as spraying, but which needs to be highly reliable, such as the automotive exhaust manifold 48 shown in FIG. 17, or a member whose film particularly needs to be sound, such as a gas turbine member or a jet engine member.

In this example, the member such as the reaction tower 106 or the like is immersed in a sodium hydrogensulfate/sodium fluoride solution to activate the surface thereof. Thereafter, an Re salt and a W salt are dissolved into a KCl—NaCl supporting electrolyte, and fused-salt plating is performed at 700 to 1000° C. to electrocrystallize an Re—W alloy on the surface of the member such as the reaction tower 106 or the like. Then, fused-salt plating is performed in an $NiCl_2$—$AlCl_3$—

NaCl—$ZrCl_4$ fused-salt at 200 to 800° C. to electrocrystallize an Ni—Al(X) alloy (X=Zr, Y) on the surface of the member such as the reaction tower 106 or the like. $ZrCl_4$ may be replaced with $YCl_3$ or the like.

The above fused-salt plating process produces a coating layer comprising the diffusion barrier layer (Re— W(M) alloy layer) 18 and the diffusion alloy layer 20 in the form of an Ni—Al(X) alloy layer (X=Zr, Y) shown in FIG. 6, the coating layer being dense with a porosity less than 0.10 by volume and defect-free. This makes it possible to keep the apparatus in sound condition for a longer period of time than heretofore. Since the apparatus can be used at high temperatures, the reaction tower 106, which has heretofore been made of ceramics for use at 1100° C. or higher, may be replaced with a metal reaction tower. As a result, since the heat transfer capability of metal can be used, any ancillary combustor may be dispensed with, and the apparatus may be made simpler and less costly.

If the example is applied to an automotive exhaust manifold, a gas turbine member, or a jet engine member, then the coating layer will not be fatally oxidized and corroded for 1000 hours or more and remain in sound condition even when the surface temperature of the coating layer reaches 1100 to 1200° C. The apparatus are therefore capable of combustion at high temperatures.

(6) Gas Turbine Member, Jet Engine Member, Etc.:

The gas turbine combustor 84 shown in FIGS. 22A and 22B, the gas turbine rotor blade 80 shown in FIG. 23, the gas turbine stator vane 82 shown in FIG. 24, etc. have regions having a small curvature and a relatively simple shape, and exposed to a high-temperature combustion gas. These regions can be processed by spraying or a physical vapor deposition (PVD). If a film is grown by a physical process, however, the adhesion between the film and the metal base is poor and the film may be peeled off. Therefore, it is necessary to roughen the surface of the metal base in advance to give an anchor effect to the film, thereby increasing the adhesion between the film and the metal base. The example is applied to the gas turbine combustor 84 made of Co-base alloy Stellite 250 (Co-30% Cr-10% Fe). However, the example is also applicable to a gas turbine stator vane, a gas turbine rotor blade, or a jet engine member.

In this example, the member such as the gas turbine combustor 84 or the like is processed by alumina shot blasting to remove oxides from the surface thereof and moderately roughen the surface thereof. The recesses of the surface irregularities should preferably have a depth in the range from 1 to 20 μm. Thereafter, the member is coated with an Re—W alloy having a thickness ranging from 0.5 to 30 μm, for example, by PVD. After the surface of the Re—W alloy is processed by alumina shot blasting, a CoNiCrAlY alloy is sprayed to a thickness ranging from 30 to 400 μm, for example, on the surface of the Re—W alloy.

By treating the member as described above, it is possible to form a coating layer shown in FIG. 11 comprising the diffusion barrier layer (Re—W(M) alloy layer) 18 and the corrosion-resistant alloy layer 34 made of a CoNiCrAlY alloy, on the surface of the member such as the gas turbine combustor 84 or the like. The member may be used as it is in an environment at 1200° C. or lower. If the member is to be used in an environment at 1200° C. or higher, then a $ZrO_2$ ceramics coating (so-called heat shield coating) is applied to the member to form a ceramic layer 24 having a thickness ranging from 100 to 400 μm, as shown in FIG. 12. This makes it possible to produce gas turbines, jet engines, etc., which are capable of combustion at higher temperatures than heretofore and which have high thermal efficiency.

Figure 30:
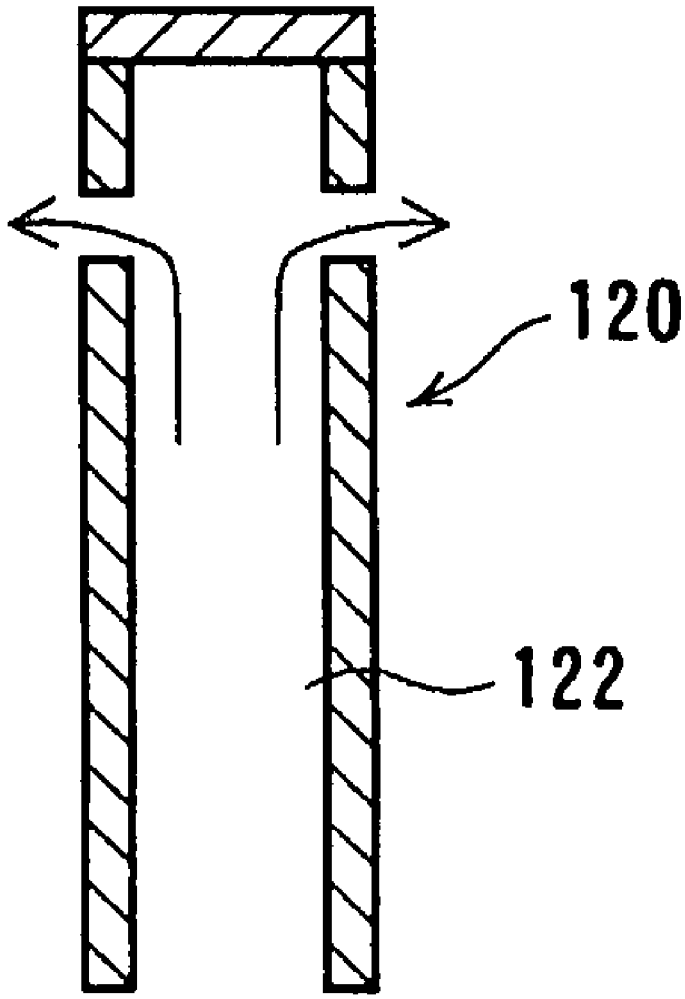
FIG. 30 is a cross-sectional view of a diffusion nozzle to which the present invention is applied.

(7) Waste Disposal Apparatus Fluidized Bed Diffusion Nozzle, Etc.:

A diffusion nozzle for use in a fluidized-bed waste incinerator or a gasifying apparatus, to which the present invention is applied, is shown in cross section in FIG. 30. Such a diffusion nozzle 120 shown in FIG. 30 has a steam or gas passage 122 defined therein, and is generally used in a flowing-sand atmosphere containing a large quantity of high-temperature chlorides. Therefore, the diffusion nozzle 120 is required to be resistant to corrosion at high temperatures and resistant to wear. The diffusion nozzle 120 is thus required to be coated with a hard film on its surface for wear resistance. This example is not limited to a diffusion nozzle for use in a fluidized-bed waste incinerator or a gasifying apparatus, but is also applicable to high-temperature apparatus members which need to be resistant to corrosion, heat, and wear.

In this example, the member such as the diffusion nozzle 120 or the like is processed by alumina shot blasting to remove oxides from the surface thereof and moderately roughen the surface thereof. The recesses of the surface irregularities should preferably have a depth in the range from 1 to 20 μm. Thereafter, the member is coated with an Re—W alloy having a thickness ranging from 10 to 50 μm, for example, by spraying. After the surface of the Re—W alloy is processed by alumina shot blasting, a CoNiCrAlY alloy with a W carbide or a Cr carbide dispersed therein is sprayed to a thickness ranging from 30 to 400 μm, for example, on the surface of the Re—W alloy.

It is thus possible to form a coating layer shown in FIG. 13 comprising the diffusion barrier layer (Re—W(M) alloy layer) 18 and the wear-resistant layer 38 made of a CoNiCrAlY alloy with the W carbide or Cr carbide 36 dispersed therein, on the surface of the member such as the diffusion nozzle 120 or the like. The member thus coated can keep the apparatus in sound condition for a long period of time in an environment where it is required to be resistant to corrosion at high temperatures and also resistant to wear. The apparatus is this made highly reliable. Since the temperature of the working fluid can be increased, the performance of the apparatus can be increased.

The present invention is not limited to the above embodiments, but may be carried out in various different forms without the scope of the technical concept thereof.

INDUSTRIAL APPLICABILITY

The present invention is used as a surface film of a high-temperature apparatus member for use at high temperatures, such as a gas turbine blade, a jet engine turbine blade, a combustor, a nozzle, a boiler heat transfer pipe, a waste disposal apparatus, a semiconductor fabrication discharge gas treating apparatus, or the like, for thereby increasing the service life and the maintenance period of the gas turbine blade and an electric generator employing the gas turbine blade, the jet engine turbine blade, the combustor, the nozzle, passenger cars and jet airplanes incorporating these devices, boiler low-heat pipes, waste disposal apparatus, semiconductor fabrication discharge gas treating apparatus, etc.

The invention claimed is:

1. A diffusion barrier alloy film comprising:

a diffusion barrier layer made of an Re—W alloy σ phase containing 12.5 to 56.5% of W in terms of atomic composition and the remainder of Re excluding unavoidable impurities:

a diffusion alloy layer coating a surface of said diffusion barrier layer, said diffusion alloy layer containing 10% or greater and less than 50% of Al, Cr, or Si in terms of atomic composition; and a W-dispersed layer with W dispersed therein, said W-dispersed layer being located between said diffusion barrier layer and said diffusion alloy layer.

2. A diffusion barrier alloy film according to claim 1, wherein said diffusion barrier layer is formed by performing Re or Re alloy plating and W or W alloy plating on a surface of a metal base, and thereafter heat-treating the plated metal base at 1200° C. or higher.

3. A diffusion barrier alloy film according to claim 1, further comprising an Re-dispersed layer with Re dispersed therein, disposed in an interface between said diffusion barrier layer and a metal base to be coated with said diffusion barrier layer.

4. A diffusion barrier alloy film according to claim 3, wherein said Re-dispersed layer and said diffusion barrier layer are formed by performing Re alloy plating in two stages with different concentrations of Re on a surface of the metal base, performing W alloy plating on the plated surface of the metal base, and thereafter heat-treating the plated metal base at 1200° C. or higher.

5. A diffusion barrier alloy film comprising:

a diffusion barrier layer made essentially of an Re—W alloy σ phase containing 12.5 to 56.5% of W and 20 to 60% of Re in terms of atomic composition, the total quantity of W and Re being 50% or greater, and, excluding unavoidable impurities, the remainder being of at least one selected from Cr, Ni, Co, and Fe:

a diffusion alloy layer coating a surface of said diffusion barrier layer, said diffusion alloy layer containing 10% or greater and less than 50% of Al, Cr, or Si in terms of atomic composition; and a W-dispersed layer with W dispersed therein, said W-dispersed layer being located between said diffusion barrier layer and said diffusion alloy layer.

6. A diffusion barrier alloy film according to claim 5, wherein said diffusion barrier layer is formed by performing Re or Re alloy plating and W or W alloy plating on a surface of a metal base, and thereafter heat-treating the plated metal base at 1200° C. or higher.

7. A diffusion barrier alloy film according to claim 5, further comprising an Re-dispersed layer with Re dispersed therein, disposed in an interface between said diffusion barrier layer and a metal base to be coated with said diffusion barrier layer.

8. A high-temperature apparatus member comprising:

a metal base:

a diffusion barrier layer made of an Re—W alloy σ phase containing 12.5 to 56.5% of W in terms of atomic composition and the remainder of Re excluding unavoidable impurities, said diffusion barrier layer coating a surface of said metal base;

a diffusion alloy layer coating a surface of said diffusion barrier layer, said diffusion alloy layer containing 10% or greater and less than 50% of Al, Cr, or Si in terms of atomic composition; and a W-dispersed layer with W dispersed therein, said W-dispersed layer being located between said diffusion barrier layer and said diffusion alloy layer.

9. A high-temperature apparatus member according to claim 8, further comprising an Re-dispersed layer with Re dispersed therein, between said metal base and said diffusion barrier layer.

10. A high-temperature apparatus member according to claim 8, wherein said diffusion alloy layer has a surface covered with a ceramics layer.

11. A high-temperature apparatus member comprising:

a metal base, a diffusion barrier layer made essentially of an Re—W alloy σ phase containing 12.5 to 56.5% of W and 20 to 60% of Re in terms of atomic composition, the total quantity of W and Re being 50% or greater, and, excluding unavoidable impurities, the remainder being of at least one selected from Cr, Ni, Co, and Fe, said diffusion barrier layer coating a surface of said metal base;

a diffusion alloy layer coating a surface of said diffusion barrier layer, said diffusion alloy layer containing 10% or greater and less than 50% of Al, Cr, or Si in terms of atomic composition; and a W-dispersed layer with W dispersed therein, said W-dispersed layer being located between said diffusion barrier layer and said diffusion alloy layer.

12. A high-temperature apparatus member according to claim 11, further comprising an Re-dispersed layer with Re dispersed therein, between said metal base and said diffusion barrier layer.

* * * * *